US011342671B2

(12) United States Patent
Téllez

(10) Patent No.: US 11,342,671 B2
(45) Date of Patent: May 24, 2022

(54) DUAL-BAND ANTENNA TOPOLOGY

(71) Applicant: Sonos, Inc., Santa Barbara, CA (US)

(72) Inventor: Gregorio Téllez, Goleta, CA (US)

(73) Assignee: Sonos, Inc., Santa Barbara, CA (US)

( * ) Notice: Subject to any disclaimer, the term of this patent is extended or adjusted under 35 U.S.C. 154(b) by 0 days.

(21) Appl. No.: 16/435,024

(22) Filed: Jun. 7, 2019

(65) Prior Publication Data

US 2020/0388922 A1 Dec. 10, 2020

(51) Int. Cl.

| | |
|---|---|
| ***H01Q 5/378*** | (2015.01) |
| ***H01Q 13/10*** | (2006.01) |
| ***H01Q 1/38*** | (2006.01) |
| ***H01Q 1/48*** | (2006.01) |

(52) U.S. Cl.

CPC ..... *H01Q 5/378* (2015.01); *H01Q 1/38* (2013.01); *H01Q 1/48* (2013.01); *H01Q 13/103* (2013.01)

(58) Field of Classification Search

CPC ..... H01Q 5/378; H01Q 1/48; H01Q 1/38; H01Q 13/103

See application file for complete search history.

(56) References Cited

U.S. PATENT DOCUMENTS

| | | | | |
|---|---|---|---|---|
| 5,440,644 | A | 8/1995 | Farinelli et al. | |
| 5,761,320 | A | 6/1998 | Farinelli et al. | |
| 5,828,348 | A * | 10/1998 | Tassoudji | H01Q 11/08 343/895 |
| 5,923,902 | A | 7/1999 | Inagaki | |
| 6,032,202 | A | 2/2000 | Lea et al. | |
| 6,246,374 | B1 * | 6/2001 | Perrotta | H01Q 1/242 343/702 |
| 6,256,554 | B1 | 7/2001 | DiLorenzo | |
| 6,404,811 | B1 | 6/2002 | Cvetko et al. | |
| 6,469,633 | B1 | 10/2002 | Wachter et al. | |
| 6,522,886 | B1 | 2/2003 | Youngs et al. | |
| 6,611,537 | B1 | 8/2003 | Edens et al. | |
| 6,631,410 | B1 | 10/2003 | Kowalski et al. | |
| 6,757,517 | B2 | 6/2004 | Chang et al. | |
| 6,778,869 | B2 | 8/2004 | Champion | |

(Continued)

FOREIGN PATENT DOCUMENTS

| | | | | |
|---|---|---|---|---|
| EP | 1389853 | A1 | 2/2004 | |
| JP | 2012235224 | A * | 11/2012 | H01Q 1/38 |

(Continued)

OTHER PUBLICATIONS

AudioTron Quick Start Guide, Version 1.0, Mar. 2001, 24 pages.

(Continued)

*Primary Examiner* — Hai V Tran
*Assistant Examiner* — Bamidele A Jegede

(57) ABSTRACT

An example dual-band antenna includes a substrate and a primary radiator disposed on the substrate and connected to a transmission line for driving the primary radiator, where the primary radiator, when driven via the transmission line, has a first resonant frequency. The dual-band antenna also includes a secondary radiator disposed on the substrate and unconnected to the primary radiator, where the primary radiator, when driven via the transmission line, induces a current in the secondary radiator such that the secondary radiator has a second resonant frequency different from the first resonant frequency.

19 Claims, 11 Drawing Sheets

(56) References Cited

U.S. PATENT DOCUMENTS 7,130,608 B2 10/2006 Hollstrom et al.
7,130,616 B2 10/2006 Janik
7,143,939 B2 12/2006 Henzerling
7,236,773 B2 6/2007 Thomas
7,295,548 B2 11/2007 Blank et al.
7,391,791 B2 6/2008 Balassanian et al.
7,483,538 B2 1/2009 McCarty et al.
7,571,014 B1 8/2009 Lambourne et al.
7,630,501 B2 12/2009 Blank et al.
7,643,894 B2 1/2010 Braithwaite et al.
7,657,910 B1 2/2010 McAulay et al.
7,853,341 B2 12/2010 McCarty et al.
7,987,294 B2 7/2011 Bryce et al.
8,014,423 B2 9/2011 Thaler et al.
8,045,952 B2 10/2011 Oureshey et al.
8,103,009 B2 1/2012 McCarty et al.
8,234,395 B2 7/2012 Millington et al.
8,483,853 B1 7/2013 Lambourne
8,754,817 B1 * 6/2014 Kuo ..... H01Q 1/243 343/700 MS
8,942,252 B2 1/2015 Balassanian et al.
9,077,066 B1 * 7/2015 Lee ..... H01Q 9/0407
2001/0005181 A1 * 6/2001 Desclos ..... H01Q 3/12 343/817
2001/0042107 A1 11/2001 Palm
2002/0022453 A1 2/2002 Balog et al.
2002/0026442 A1 2/2002 Lipscomb et al.
2002/0124097 A1 9/2002 Isely et al.
2003/0157951 A1 8/2003 Hasty, V
2003/0210206 A1 * 11/2003 Phillips ..... H01Q 1/50 343/895
2004/0021608 A1 * 2/2004 Kojima ..... H01Q 19/005 343/702
2004/0024478 A1 2/2004 Hans et al.
2004/0108957 A1 * 6/2004 Umehara ..... H01Q 1/243 343/700 MS
2004/0201527 A1 * 10/2004 Hani ..... H01Q 9/0442 343/702
2005/0030232 A1 * 2/2005 Monebhurrun ..... H01Q 9/30 343/702
2005/0093750 A1 * 5/2005 Vance ..... H01Q 5/371 343/702
2006/0017624 A1 * 1/2006 Nagano ..... H01Q 1/242 343/702
2006/0038736 A1 * 2/2006 Hui ..... H01Q 1/521 343/835
2006/0125703 A1 * 6/2006 Ma ..... H01Q 13/103 343/767
2006/0152419 A1 * 7/2006 Sato ..... H01Q 5/364 343/702
2007/0035458 A1 * 2/2007 Ohba ..... H01Q 5/371 343/702
2007/0120745 A1 * 5/2007 Qi ..... H01Q 21/29 343/702
2007/0142944 A1 6/2007 Goldberg et al.
2007/0182658 A1 * 8/2007 Ozden ..... H01Q 9/0442 343/866
2007/0273606 A1 * 11/2007 Mak ..... H01Q 9/30 343/876
2009/0021448 A1 * 1/2009 Tsai ..... H01Q 1/38 343/893
2009/0115671 A1 * 5/2009 Ishihara ..... H01Q 1/243 343/702
2010/0033383 A1 * 2/2010 Yamamoto ..... H01Q 1/243 343/702
2010/0103069 A1 * 4/2010 Wang ..... H01Q 9/42 343/846
2010/0171675 A1 * 7/2010 Borja ..... H01Q 9/0414 343/798
2011/0084883 A1 * 4/2011 Wong ..... H01Q 9/0471 343/702
2011/0122040 A1 * 5/2011 Wakabayashi ..... H01Q 9/16 343/833
2011/0156958 A1 * 6/2011 Wong ..... H01Q 5/371 343/700 MS
2011/0175789 A1 * 7/2011 Lee ..... H01Q 5/20 343/853
2011/0183633 A1 * 7/2011 Ohba ..... H01Q 9/42 455/77
2011/0260939 A1 * 10/2011 Korva ..... H01Q 9/0421 343/725
2012/0013511 A1 * 1/2012 Sumi ..... H01Q 1/243 343/702
2012/0105292 A1 * 5/2012 Wong ..... H01Q 5/357 343/749
2012/0146865 A1 * 6/2012 Hayashi ..... H01Q 9/42 343/750
2012/0242555 A1 * 9/2012 Hsieh ..... H01Q 5/378 343/833
2012/0262343 A1 * 10/2012 Radojkovic ..... H04M 1/026 343/702
2012/0287012 A1 * 11/2012 Aizawa ..... H01Q 1/243 343/853
2012/0313830 A1 * 12/2012 Lee ..... H01Q 1/243 343/729
2013/0113666 A1 * 5/2013 Orsi ..... H01Q 5/35 343/745
2013/0154886 A1 * 6/2013 Isohatala ..... H01Q 9/045 343/702
2013/0154888 A1 * 6/2013 Lin ..... H01Q 5/371 343/745
2013/0201061 A1 * 8/2013 Chiang ..... H01Q 1/243 343/702
2013/0241793 A1 * 9/2013 Ai ..... H01Q 1/38 343/853
2013/0257674 A1 * 10/2013 Li ..... H01Q 5/378 343/853
2013/0307753 A1 * 11/2013 Andrenko ..... H01Q 1/243 343/904
2014/0126172 A1 * 5/2014 Fahlgren ..... H04M 1/0202 361/814
2014/0128007 A1 * 5/2014 Chen ..... H04B 1/18 455/77
2014/0266917 A1 * 9/2014 De Luis ..... H01Q 1/38 343/700 MS
2014/0266941 A1 * 9/2014 Vazquez ..... H01Q 9/42 343/746
2014/0327588 A1 * 11/2014 Tran ..... H01Q 21/24 343/727
2014/0375520 A1 * 12/2014 Wu ..... H01Q 1/245 343/841
2015/0022422 A1 * 1/2015 Chang ..... H01Q 1/243 343/861
2015/0214612 A1 * 7/2015 Chen ..... H01Q 1/525 343/841
2016/0043467 A1 * 2/2016 Desclos ..... H01Q 5/328 343/745
2016/0268692 A1 * 9/2016 Koga ..... H01Q 1/48
2016/0322705 A1 * 11/2016 Huang ..... H01Q 1/243
2017/0179581 A1 * 6/2017 Puuri ..... H01Q 7/005
2017/0264002 A1 * 9/2017 Yen ..... H01Q 9/42
2017/0358845 A1 * 12/2017 Yen ..... H01Q 5/40
2018/0062243 A1 * 3/2018 Yang ..... H01Q 1/2291

FOREIGN PATENT DOCUMENTS

WO 200153994 7/2001
WO 2003093950 A2 11/2003

OTHER PUBLICATIONS

AudioTron Reference Manual, Version 3.0, May 2002, 70 pages.
AudioTron Setup Guide, Version 3.0, May 2002, 38 pages.
Bluetooth. "Specification of the Bluetooth System: The ad hoc SCATTERNET for affordable and highly functional wireless connectivity," Core, Version 1.0 A, Jul. 26, 1999, 1068 pages.
Bluetooth. "Specification of the Bluetooth System: Wireless connections made easy," Core, Version 1.0 B, Dec. 1, 1999, 1076 pages.

(56) References Cited

OTHER PUBLICATIONS

Dell, Inc. "Dell Digital Audio Receiver: Reference Guide," Jun. 2000, 70 pages.
Dell, Inc. "Start Here," Jun. 2000, 2 pages.
"Denon 2003-2004 Product Catalog," Denon, 2003-2004, 44 pages.
Jo et al., "Synchronized One-to-many Media Streaming with Adaptive Playout Control," Proceedings of SPIE, 2002, pp. 71-82, vol. 4861.
Jones, Stephen, "Dell Digital Audio Receiver: Digital upgrade for your analog stereo," Analog Stereo, Jun. 24, 2000 retrieved Jun. 18, 2014, 2 pages.
Louderback, Jim, "Affordable Audio Receiver Furnishes Homes With MP3," TechTV Vault. Jun. 28, 2000 retrieved Jul. 10, 2014, 2 pages.
Palm, Inc., "Handbook for the Palm VII Handheld," May 2000, 311 pages.
Presentations at WinHEC 2000, May 2000, 138 pages.
United States Patent and Trademark Office, U.S. Appl. No. 60/490,768, filed Jul. 28, 2003, entitled "Method for synchronizing audio playback between multiple networked devices," 13 pages.
United States Patent and Trademark Office, U.S. Appl. No. 60/825,407, filed Sep. 12, 2006, entitled "Controlling and manipulating groupings in a multi-zone music or media system," 82 pages.
UPnP; "Universal Plug and Play Device Architecture," Jun. 8, 2000; version 1.0; Microsoft Corporation; pp. 1-54.
Yamaha DME 64 Owner's Manual; copyright 2004, 80 pages.
Yamaha DME Designer 3.5 setup manual guide; copyright 2004, 16 pages.
Yamaha DME Designer 3.5 User Manual; Copyright 2004, 507 pages.

* cited by examiner

DUAL-BAND ANTENNA TOPOLOGY

FIELD OF THE DISCLOSURE

The present disclosure is related to consumer goods and, more particularly, to methods, systems, products, features, services, and other elements directed to media playback or some aspect thereof.

BACKGROUND

Options for accessing and listening to digital audio in an out-loud setting were limited until in 2002, when SONOS, Inc. began development of a new type of playback system. Sonos then filed one of its first patent applications in 2003, entitled "Method for Synchronizing Audio Playback between Multiple Networked Devices," and began offering its first media playback systems for sale in 2005. The Sonos Wireless Home Sound System enables people to experience music from many sources via one or more networked playback devices. Through a software control application installed on a controller (e.g., smartphone, tablet, computer, voice input device), one can play what she wants in any room having a networked playback device. Media content (e.g., songs, podcasts, video sound) can be streamed to playback devices such that each room with a playback device can play back corresponding different media content. In addition, rooms can be grouped together for synchronous playback of the same media content, and/or the same media content can be heard in all rooms synchronously.

BRIEF DESCRIPTION OF THE DRAWINGS

Features, aspects, and advantages of the presently disclosed technology may be better understood with regard to the following description, appended claims, and accompanying drawings, as listed below. A person skilled in the relevant art will understand that the features shown in the drawings are for purposes of illustrations, and variations, including different and/or additional features and arrangements thereof, are possible.

Figure 1A:
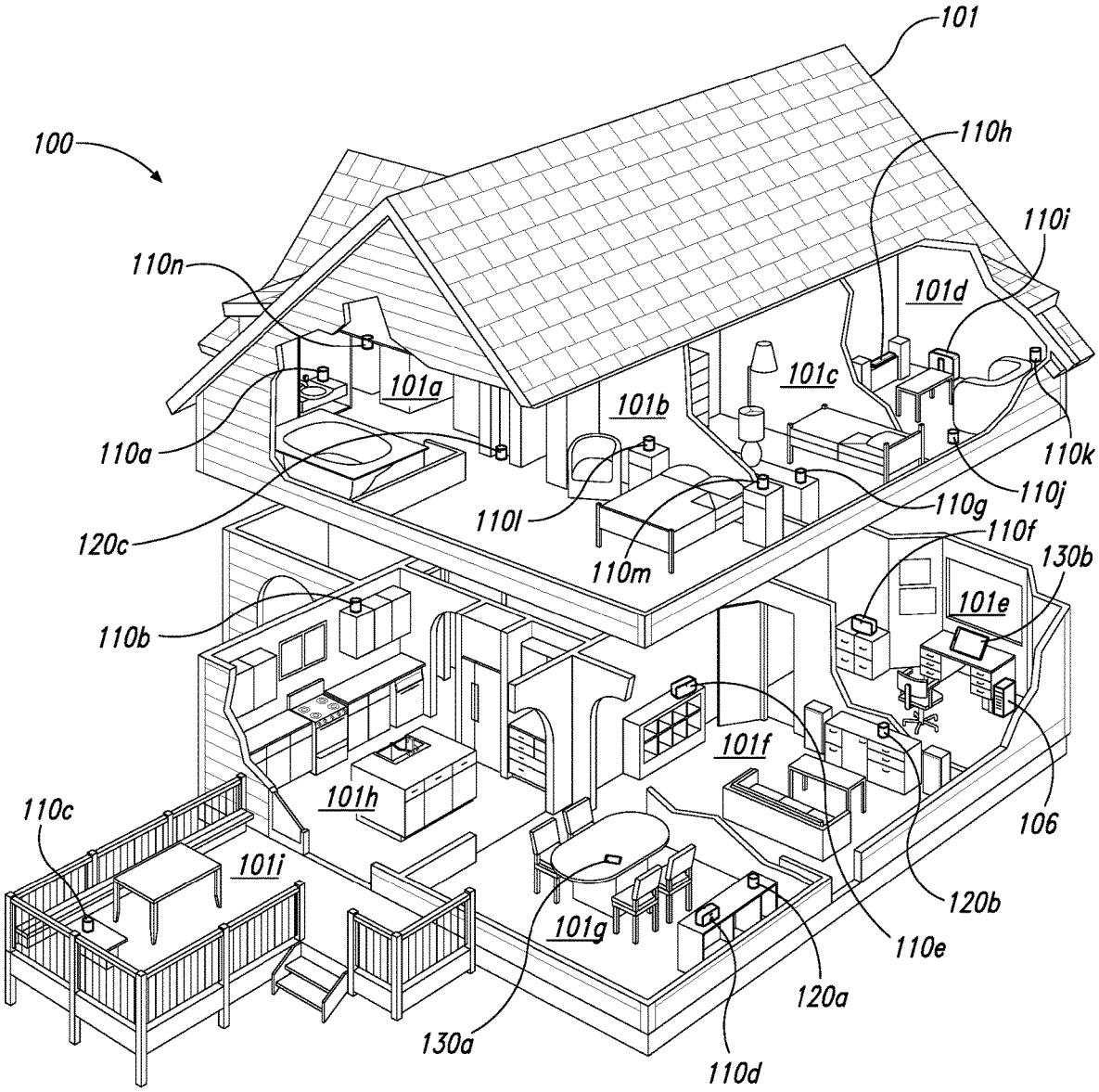
FIG. 1A is a partial cutaway view of an environment having a media playback system configured in accordance with aspects of the disclosed technology.

The drawings are for the purpose of illustrating example embodiments, but those of ordinary skill in the art will understand that the technology disclosed herein is not limited to the arrangements and/or instrumentality shown in the drawings.

DETAILED DESCRIPTION

I. Overview

Embodiments described herein relate to wireless communications devices in general, and wireless playback devices in a multi-room media playback system specifically. In particular, the embodiments herein discuss an improved dual-band antenna design that may provide increased design flexibility and operational advantages in a wireless communication device, such as a wireless, multimedia playback device.

Dual-band antennas are designed and implemented in a wide variety of consumer hardware devices. This is especially true in consumer electronics that support applications such as multi-band cellular networks, multi-band global positioning protocols (i.e., GPS and GLONASS) and wireless local area network (WLAN) systems, or similar. Industrial design requirements (e.g., aesthetics) and other space constraints have necessitated that an antenna designer use a so-called shared space to provide a single antenna element with a dual-band or multi-band behavior.

In general, the starting point to design said elements is usually a single-band radiator that owes its native characteristics to the structure on which it resides along with the length/size and aspect ratio of what is commonly deemed as the radiating element (i.e. the part of the conductive surface that is excited to produce electromagnetic radiation). To achieve a multi-band resonance behavior, further elements can be added, such as secondary/tertiary arms or radiating elements.

The constraints, however, in having the second resonant element be a part of the first element's footprint will limit the topologies chosen to achieve this dual-resonant behavior. Also, modifying one element's physical characteristic (e.g., its length) will impact the other, and vice-versa, as they are part of the same conductive structure and commonly share a feed-point location from a transmission line.

In the examples herein, dual-band antenna designs are described which, based on their unique topology, mitigate and at times fully avoid a noticeable impact to the principal element. In the following examples, the secondary resonance is achieved by coupling a secondary element to the first element in a parasitic, or capacitive manner (i.e., not in direct contact). By using this dual-band antenna topology, the primary element's characteristics are minimally altered when adding the secondary element, or when manipulating the electrical length of the secondary element using inductive/capacitive components within this secondary element, for example. In some implementations, the secondary element may be arranged as a slot radiator that capacitively couples to the primary element, such as a bent monopole, which may result in a cross-polarization of the low-band and high-band.

Accordingly, a unique dual-band antenna may be provided that is cost-effective, flexible in its design properties, and can be implemented not only in WLAN applications but other similar multi-resonant designs.

In some embodiments, for example, a dual-band antenna is provided including a substrate and a primary radiator disposed on the substrate. The primary radiator is connected to a transmission line for driving the primary radiator. The primary radiator, when driven via the transmission line, has a first resonant frequency. The dual-band antenna also includes a secondary radiator disposed on the substrate and unconnected to the primary radiator. The primary radiator, when driven via the transmission line, induces a current in the secondary radiator such that the secondary radiator has a second resonant frequency different from the first resonant frequency.

In another aspect, a method for driving a dual-band antenna is provided. The method includes driving a primary radiator via a transmission line connected to the primary radiator, where the primary radiator is disposed on a substrate and has a first resonant frequency. The method also includes inducing a current in a secondary radiator via the driven primary radiator, where the secondary radiator is disposed on the substrate and unconnected to the primary radiator, and where the secondary radiator has a second resonant frequency different from the first resonant frequency.

While some examples described herein may refer to functions performed by given actors such as "users," "listeners," and/or other entities, it should be understood that this is for purposes of explanation only. The claims should not be interpreted to require action by any such example actor unless explicitly required by the language of the claims themselves.

In the FIGS., identical reference numbers identify generally similar, and/or identical, elements. To facilitate the discussion of any particular element, the most significant digit or digits of a reference number refers to the Figure in which that element is first introduced. For example, element 110*a* is first introduced and discussed with reference to FIG. 1A. Many of the details, dimensions, angles and other features shown in the FIGS. are merely illustrative of particular embodiments of the disclosed technology. Accordingly, other embodiments can have other details, dimensions, angles and features without departing from the spirit or scope of the disclosure. In addition, those of ordinary skill in the art will appreciate that further embodiments of the various disclosed technologies can be practiced without several of the details described below.

II. Suitable Operating Environment

FIG. 1A is a partial cutaway view of a media playback system 100 distributed in an environment 101 (e.g., a house). The media playback system 100 comprises one or more playback devices 110 (identified individually as playback devices 110*a-n*), one or more network microphone devices ("NMDs"), 120 (identified individually as NMDs 120*a-c*), and one or more control devices 130 (identified individually as control devices 130*a* and 130*b*).

As used herein the term "playback device" can generally refer to a network device configured to receive, process, and output data of a media playback system. For example, a playback device can be a network device that receives and processes audio content. In some embodiments, a playback device includes one or more transducers or speakers powered by one or more amplifiers. In other embodiments, however, a playback device includes one of (or neither of) the speaker and the amplifier. For instance, a playback device can comprise one or more amplifiers configured to drive one or more speakers external to the playback device via a corresponding wire or cable.

Moreover, as used herein the term NMD (i.e., a "network microphone device") can generally refer to a network device that is configured for audio detection. In some embodiments, an NMD is a stand-alone device configured primarily for audio detection. In other embodiments, an NMD is incorporated into a playback device (or vice versa).

The term "control device" can generally refer to a network device configured to perform functions relevant to facilitating user access, control, and/or configuration of the media playback system 100.

Each of the playback devices 110 is configured to receive audio signals or data from one or more media sources (e.g., one or more remote servers, one or more local devices) and play back the received audio signals or data as sound. The one or more NMDs 120 are configured to receive spoken word commands, and the one or more control devices 130 are configured to receive user input. In response to the received spoken word commands and/or user input, the media playback system 100 can play back audio via one or more of the playback devices 110. In certain embodiments, the playback devices 110 are configured to commence playback of media content in response to a trigger. For instance, one or more of the playback devices 110 can be configured to play back a morning playlist upon detection of an associated trigger condition (e.g., presence of a user in a kitchen, detection of a coffee machine operation). In some embodiments, for example, the media playback system 100 is configured to play back audio from a first playback device (e.g., the playback device 100*a*) in synchrony with a second playback device (e.g., the playback device 100*b*). Interactions between the playback devices 110, NMDs 120, and/or control devices 130 of the media playback system 100 configured in accordance with the various embodiments of the disclosure are described in greater detail below with respect to FIGS. 1B-1H.

In the illustrated embodiment of FIG. 1A, the environment 101 comprises a household having several rooms, spaces, and/or playback zones, including (clockwise from upper left) a master bathroom 101*a*, a master bedroom 101*b*, a second bedroom 101*c*, a family room or den 101*d*, an office 101*e*, a living room 101*f*, a dining room 101*g*, a kitchen 101*h*, and an outdoor patio 101*i*. While certain embodiments and examples are described below in the context of a home environment, the technologies described herein may be implemented in other types of environments. In some embodiments, for example, the media playback system 100 can be implemented in one or more commercial settings (e.g., a restaurant, mall, airport, hotel, a retail or other store), one or more vehicles (e.g., a sports utility vehicle, bus, car, a ship, a boat, an airplane), multiple environments (e.g., a combination of home and vehicle environments), and/or another suitable environment where multi-zone audio may be desirable.

The media playback system 100 can comprise one or more playback zones, some of which may correspond to the rooms in the environment 101. The media playback system 100 can be established with one or more playback zones, after which additional zones may be added, or removed to form, for example, the configuration shown in FIG. 1A.

Each zone may be given a name according to a different room or space such as the office 101*e*, master bathroom 101*a*, master bedroom 101*b*, the second bedroom 101*c*, kitchen 101*h*, dining room 101*g*, living room 101*f*, and/or the balcony 101*i*. In some aspects, a single playback zone may include multiple rooms or spaces. In certain aspects, a single room or space may include multiple playback zones.

In the illustrated embodiment of FIG. 1A, the master bathroom 101*a*, the second bedroom 101*c*, the office 101*e*, the living room 101*f*, the dining room 101*g*, the kitchen 101*h*, and the outdoor patio 101*i* each include one playback device 110, and the master bedroom 101*b* and the den 101*d* include a plurality of playback devices 110. In the master bedroom 101*b*, the playback devices 110*l* and 110*m* may be configured, for example, to play back audio content in synchrony as individual ones of playback devices 110, as a bonded playback zone, as a consolidated playback device, and/or any combination thereof. Similarly, in the den 101*d*, the playback devices 110*h-j* can be configured, for instance, to play back audio content in synchrony as individual ones of playback devices 110, as one or more bonded playback devices, and/or as one or more consolidated playback devices. Additional details regarding bonded and consolidated playback devices are described below with respect to FIGS. 1B and 1E.

In some aspects, one or more of the playback zones in the environment 101 may each be playing different audio content. For instance, a user may be grilling on the patio 101*i* and listening to hip hop music being played by the playback device 110*c* while another user is preparing food in the kitchen 101*h* and listening to classical music played by the playback device 110*b*. In another example, a playback zone may play the same audio content in synchrony with another playback zone. For instance, the user may be in the office 101*e* listening to the playback device 110*f* playing back the same hip hop music being played back by playback device 110*c* on the patio 101*i*. In some aspects, the playback devices 110*c* and 110*f* play back the hip hop music in synchrony such that the user perceives that the audio content is being played seamlessly (or at least substantially seamlessly) while moving between different playback zones. Additional details regarding audio playback synchronization among playback devices and/or zones can be found, for example, in U.S. Pat. No. 8,234,395 entitled, "System and method for synchronizing operations among a plurality of independently clocked digital data processing devices," which is incorporated herein by reference in its entirety.

a. Suitable Media Playback System

Figure 1B:
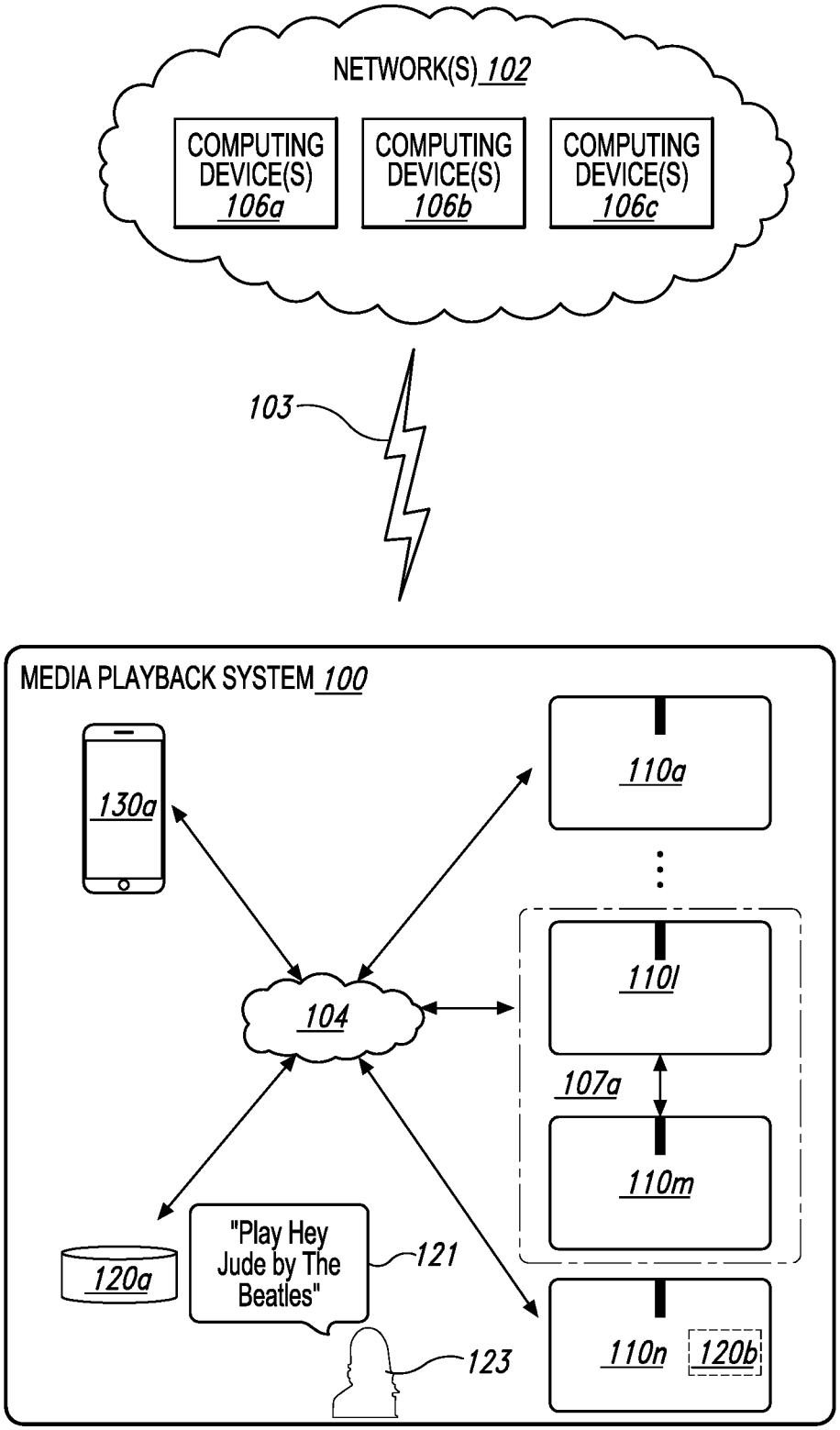
FIG. 1B is a schematic diagram of the media playback system of FIG. 1A and one or more networks.

FIG. 1B is a schematic diagram of the media playback system 100 and a cloud network 102. For ease of illustration, certain devices of the media playback system 100 and the cloud network 102 are omitted from FIG. 1B. One or more communication links 103 (referred to hereinafter as "the links 103") communicatively couple the media playback system 100 and the cloud network 102.

The links 103 can comprise, for example, one or more wired networks, one or more wireless networks, one or more wide area networks (WAN), one or more local area networks (LAN), one or more personal area networks (PAN), one or more telecommunication networks (e.g., one or more Global System for Mobiles (GSM) networks, Code Division Multiple Access (CDMA) networks, Long-Term Evolution (LTE) networks, 5G communication network networks, and/or other suitable data transmission protocol networks), etc. The cloud network 102 is configured to deliver media content (e.g., audio content, video content, photographs, social media content) to the media playback system 100 in response to a request transmitted from the media playback system 100 via the links 103. In some embodiments, the cloud network 102 is further configured to receive data (e.g. voice input data) from the media playback system 100 and correspondingly transmit commands and/or media content to the media playback system 100.

The cloud network 102 comprises computing devices 106 (identified separately as a first computing device 106*a*, a second computing device 106*b*, and a third computing device 106*c*). The computing devices 106 can comprise individual computers or servers, such as, for example, a media streaming service server storing audio and/or other media content, a voice service server, a social media server, a media playback system control server, etc. In some embodiments, one or more of the computing devices 106 comprise modules of a single computer or server. In certain embodiments, one or more of the computing devices 106 comprise one or more modules, computers, and/or servers. Moreover, while the cloud network 102 is described above in the context of a single cloud network, in some embodiments the cloud network 102 comprises a plurality of cloud networks comprising communicatively coupled computing devices. Furthermore, while the cloud network 102 is shown in FIG. 1B as having three of the computing devices 106, in some embodiments, the cloud network 102 comprises fewer (or more than) three computing devices 106.

The media playback system 100 is configured to receive media content from the networks 102 via the links 103. The received media content can comprise, for example, a Uniform Resource Identifier (URI) and/or a Uniform Resource Locator (URL). For instance, in some examples, the media playback system 100 can stream, download, or otherwise obtain data from a URI or a URL corresponding to the received media content. A network 104 communicatively couples the links 103 and at least a portion of the devices (e.g., one or more of the playback devices 110, NMDs 120, and/or control devices 130) of the media playback system 100. The network 104 can include, for example, a wireless network (e.g., a WiFi network, a Bluetooth, a Z-Wave network, a ZigBee, and/or other suitable wireless communication protocol network) and/or a wired network (e.g., a network comprising Ethernet, Universal Serial Bus (USB), and/or another suitable wired communication). As those of ordinary skill in the art will appreciate, as used herein, "WiFi" can refer to several different communication protocols including, for example, Institute of Electrical and Electronics Engineers (IEEE) 802.11a, 802.11b, 802.11g, 802.11n, 802.11ac, 802.11ac, 802.11ad, 802.11af, 802.11ah, 802.11ai, 802.11aj, 802.11aq, 802.11ax, 802.11ay, 802.15, etc. transmitted at 2.4 Gigahertz (GHz), 5 GHz, and/or another suitable frequency.

In some embodiments, the network 104 comprises a dedicated communication network that the media playback system 100 uses to transmit messages between individual devices and/or to transmit media content to and from media content sources (e.g., one or more of the computing devices 106). In certain embodiments, the network 104 is configured to be accessible only to devices in the media playback system 100, thereby reducing interference and competition with other household devices. In other embodiments, however, the network 104 comprises an existing household communication network (e.g., a household WiFi network). In some embodiments, the links 103 and the network 104 comprise one or more of the same networks. In some aspects, for example, the links 103 and the network 104 comprise a telecommunication network (e.g., an LTE network, a 5G network). Moreover, in some embodiments, the media playback system 100 is implemented without the network 104, and devices comprising the media playback system 100 can communicate with each other, for example, via one or more direct connections, PANs, telecommunication networks, and/or other suitable communication links.

In some embodiments, audio content sources may be regularly added or removed from the media playback system 100. In some embodiments, for example, the media playback system 100 performs an indexing of media items when one or more media content sources are updated, added to, and/or removed from the media playback system 100. The media playback system 100 can scan identifiable media items in some or all folders and/or directories accessible to the playback devices 110, and generate or update a media content database comprising metadata (e.g., title, artist, album, track length) and other associated information (e.g., URIs, URLs) for each identifiable media item found. In some embodiments, for example, the media content database is stored on one or more of the playback devices 110, network microphone devices 120, and/or control devices 130.

In the illustrated embodiment of FIG. 1B, the playback devices 110*l* and 110*m* comprise a group 107*a*. The playback devices 110*l* and 110*m* can be positioned in different rooms in a household and be grouped together in the group 107*a* on a temporary or permanent basis based on user input received at the control device 130*a* and/or another control device 130 in the media playback system 100. When arranged in the group 107*a*, the playback devices 110*l* and 110*m* can be configured to play back the same or similar audio content in synchrony from one or more audio content sources. In certain embodiments, for example, the group 107*a* comprises a bonded zone in which the playback devices 110*l* and 110*m* comprise left audio and right audio channels, respectively, of multi-channel audio content, thereby producing or enhancing a stereo effect of the audio content. In some embodiments, the group 107*a* includes additional playback devices 110. In other embodiments, however, the media playback system 100 omits the group 107*a* and/or other grouped arrangements of the playback devices 110.

The media playback system 100 includes the NMDs 120*a* and 120*d*, each comprising one or more microphones configured to receive voice utterances from a user. In the illustrated embodiment of FIG. 1B, the NMD 120*a* is a standalone device and the NMD 120*d* is integrated into the playback device 110*n*. The NMD 120*a*, for example, is configured to receive voice input 121 from a user 123. In some embodiments, the NMD 120*a* transmits data associated with the received voice input 121 to a voice assistant service (VAS) configured to (i) process the received voice input data and (ii) transmit a corresponding command to the media playback system 100. In some aspects, for example, the computing device 106*c* comprises one or more modules and/or servers of a VAS (e.g., a VAS operated by one or more of SONOS®, AMAZON®, GOOGLE® APPLE®, MICROSOFT®). The computing device 106*c* can receive the voice input data from the NMD 120*a* via the network 104 and the links 103. In response to receiving the voice input data, the computing device 106*c* processes the voice input data (i.e., "Play Hey Jude by The Beatles"), and determines that the processed voice input includes a command to play a song (e.g., "Hey Jude"). The computing device 106*c* accordingly transmits commands to the media playback system 100 to play back "Hey Jude" by the Beatles from a suitable media service (e.g., via one or more of the computing devices 106) on one or more of the playback devices 110.

b. Suitable Playback Devices

Figure 1C:
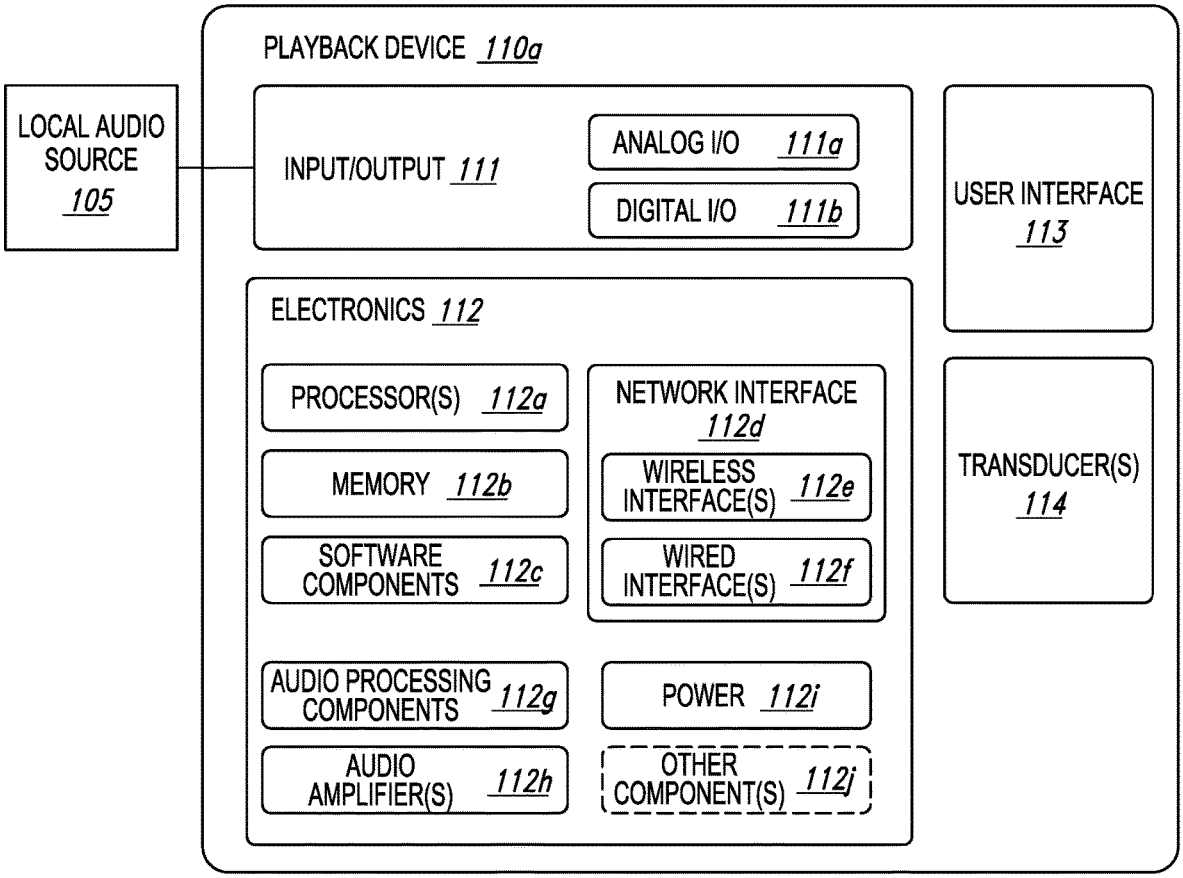
FIG. 1C is a block diagram of a playback device.

FIG. 1C is a block diagram of the playback device 110*a* comprising an input/output 111. The input/output 111 can include an analog I/O 111*a* (e.g., one or more wires, cables, and/or other suitable communication links configured to carry analog signals) and/or a digital I/O 111*b* (e.g., one or more wires, cables, or other suitable communication links configured to carry digital signals). In some embodiments, the analog I/O 111*a* is an audio line-in input connection comprising, for example, an auto-detecting 3.5 mm audio line-in connection. In some embodiments, the digital I/O 111*b* comprises a Sony/Philips Digital Interface Format (S/PDIF) communication interface and/or cable and/or a Toshiba Link (TOSLINK) cable. In some embodiments, the digital I/O 111*b* comprises an High-Definition Multimedia Interface (HDMI) interface and/or cable. In some embodiments, the digital I/O 111*b* includes one or more wireless communication links comprising, for example, a radio frequency (RF), infrared, WiFi, Bluetooth, or another suitable communication protocol. In certain embodiments, the analog I/O 111*a* and the digital 111*b* comprise interfaces (e.g., ports, plugs, jacks) configured to receive connectors of cables transmitting analog and digital signals, respectively, without necessarily including cables.

The playback device 110*a*, for example, can receive media content (e.g., audio content comprising music and/or other sounds) from a local audio source 105 via the input/output 111 (e.g., a cable, a wire, a PAN, a Bluetooth connection, an ad hoc wired or wireless communication network, and/or another suitable communication link). The local audio source 105 can comprise, for example, a mobile device (e.g., a smartphone, a tablet, a laptop computer) or another suitable audio component (e.g., a television, a desktop computer, an amplifier, a phonograph, a Blu-ray player, a memory storing digital media files). In some aspects, the local audio source 105 includes local music libraries on a smartphone, a computer, a networked-attached storage (NAS), and/or another suitable device configured to store media files. In certain embodiments, one or more of the playback devices 110, NMDs 120, and/or control devices 130 comprise the local audio source 105. In other embodiments, however, the media playback system omits the local audio source 105 altogether. In some embodiments, the playback device 110*a* does not include an input/output 111 and receives all audio content via the network 104.

The playback device 110*a* further comprises electronics 112, a user interface 113 (e.g., one or more buttons, knobs, dials, touch-sensitive surfaces, displays, touchscreens), and one or more transducers 114 (referred to hereinafter as "the transducers 114"). The electronics 112 is configured to receive audio from an audio source (e.g., the local audio source 105) via the input/output 111, one or more of the computing devices 106*a-c* via the network 104 (FIG. 1B)), amplify the received audio, and output the amplified audio for playback via one or more of the transducers 114. In some embodiments, the playback device 110*a* optionally includes one or more microphones 115 (e.g., a single microphone, a plurality of microphones, a microphone array) (hereinafter referred to as "the microphones 115"). In certain embodiments, for example, the playback device 110*a* having one or more of the optional microphones 115 can operate as an NMD configured to receive voice input from a user and correspondingly perform one or more operations based on the received voice input.

In the illustrated embodiment of FIG. 1C, the electronics 112 comprise one or more processors 112*a* (referred to hereinafter as "the processors 112*a*"), memory 112*b*, software components 112*c*, a network interface 112*d*, one or more audio processing components 112*g* (referred to hereinafter as "the audio components 112*g*"), one or more audio amplifiers 112*h* (referred to hereinafter as "the amplifiers 112*h*"), and power 112*i* (e.g., one or more power supplies, power cables, power receptacles, batteries, induction coils, Power-over Ethernet (POE) interfaces, and/or other suitable sources of electric power). In some embodiments, the electronics 112 optionally include one or more other components 112*j* (e.g., one or more sensors, video displays, touchscreens, battery charging bases).

The processors 112*a* can comprise clock-driven computing component(s) configured to process data, and the memory 112*b* can comprise a computer-readable medium (e.g., a tangible, non-transitory computer-readable medium, data storage loaded with one or more of the software components 112*c*) configured to store instructions for performing various operations and/or functions. The processors 112*a* are configured to execute the instructions stored on the memory 112*b* to perform one or more of the operations. The operations can include, for example, causing the playback device 110*a* to retrieve audio data from an audio source (e.g., one or more of the computing devices 106*a-c* (FIG. 1B)), and/or another one of the playback devices 110. In some embodiments, the operations further include causing the playback device 110*a* to send audio data to another one of the playback devices 110*a* and/or another device (e.g., one of the NMDs 120). Certain embodiments include operations causing the playback device 110*a* to pair with another of the one or more playback devices 110 to enable a multi-channel audio environment (e.g., a stereo pair, a bonded zone).

The processors 112*a* can be further configured to perform operations causing the playback device 110*a* to synchronize playback of audio content with another of the one or more playback devices 110. As those of ordinary skill in the art will appreciate, during synchronous playback of audio content on a plurality of playback devices, a listener will preferably be unable to perceive time-delay differences between playback of the audio content by the playback device 110*a* and the other one or more other playback devices 110. Additional details regarding audio playback synchronization among playback devices can be found, for example, in U.S. Pat. No. 8,234,395, which was incorporated by reference above.

In some embodiments, the memory 112*b* is further configured to store data associated with the playback device 110*a*, such as one or more zones and/or zone groups of which the playback device 110*a* is a member, audio sources accessible to the playback device 110*a*, and/or a playback queue that the playback device 110*a* (and/or another of the one or more playback devices) can be associated with. The stored data can comprise one or more state variables that are periodically updated and used to describe a state of the playback device 110*a*. The memory 112*b* can also include data associated with a state of one or more of the other devices (e.g., the playback devices 110, NMDs 120, control devices 130) of the media playback system 100. In some aspects, for example, the state data is shared during predetermined intervals of time (e.g., every 5 seconds, every 10 seconds, every 60 seconds) among at least a portion of the devices of the media playback system 100, so that one or more of the devices have the most recent data associated with the media playback system 100.

The network interface 112*d* is configured to facilitate a transmission of data between the playback device 110*a* and one or more other devices on a data network such as, for example, the links 103 and/or the network 104 (FIG. 1B). The network interface 112*d* is configured to transmit and receive data corresponding to media content (e.g., audio content, video content, text, photographs) and other signals (e.g., non-transitory signals) comprising digital packet data including an Internet Protocol (IP)-based source address and/or an IP-based destination address. The network interface 112*d* can parse the digital packet data such that the electronics 112 properly receives and processes the data destined for the playback device 110*a*.

In the illustrated embodiment of FIG. 1C, the network interface 112*d* comprises one or more wireless interfaces 112*e* (referred to hereinafter as "the wireless interface 112*e*"). The wireless interface 112*e* may be, for example, a suitable interface comprising one or more antennas. A given antenna of the wireless interface 112*e* may be a single-band antenna or a dual-band antenna having resonance on multiple frequencies, as discussed further below. The wireless interface 112*e* can be configured to wirelessly communicate with one or more other devices (e.g., one or more of the other playback devices 110, NMDs 120, and/or control devices 130) that are communicatively coupled to the network 104 (FIG. 1B) in accordance with a suitable wireless communication protocol (e.g., WiFi, Bluetooth, LTE).

In some embodiments, the network interface 112*d* optionally includes a wired interface 112*f* (e.g., an interface or receptacle configured to receive a network cable such as an Ethernet, a USB-A, USB-C, and/or Thunderbolt cable) configured to communicate over a wired connection with other devices in accordance with a suitable wired communication protocol. In certain embodiments, the network interface 112*d* includes the wired interface 112*f* and excludes the wireless interface 112*e*. In some embodiments, the electronics 112 excludes the network interface 112*d* altogether and transmits and receives media content and/or other data via another communication path (e.g., the input/output 111).

The audio components 112*g* are configured to process and/or filter data comprising media content received by the electronics 112 (e.g., via the input/output 111 and/or the network interface 112*d*) to produce output audio signals. In some embodiments, the audio processing components 112*g* comprise, for example, one or more digital-to-analog converters (DAC), audio preprocessing components, audio enhancement components, a digital signal processors (DSPs), and/or other suitable audio processing components, modules, circuits, etc. In certain embodiments, one or more of the audio processing components 112*g* can comprise one or more subcomponents of the processors 112*a*. In some embodiments, the electronics 112 omits the audio processing components 112*g*. In some aspects, for example, the processors 112*a* execute instructions stored on the memory 112*b* to perform audio processing operations to produce the output audio signals.

The amplifiers 112*h* are configured to receive and amplify the audio output signals produced by the audio processing components 112*g* and/or the processors 112*a*. The amplifiers 112*h* can comprise electronic devices and/or components configured to amplify audio signals to levels sufficient for driving one or more of the transducers 114. In some embodiments, for example, the amplifiers 112*h* include one or more switching or class-D power amplifiers. In other embodiments, however, the amplifiers include one or more other types of power amplifiers (e.g., linear gain power amplifiers, class-A amplifiers, class-B amplifiers, class-AB amplifiers, class-C amplifiers, class-D amplifiers, class-E amplifiers, class-F amplifiers, class-G and/or class H amplifiers, and/or another suitable type of power amplifier). In certain embodiments, the amplifiers 112*h* comprise a suitable combination of two or more of the foregoing types of power amplifiers. Moreover, in some embodiments, individual ones of the amplifiers 112*h* correspond to individual ones of the transducers 114. In other embodiments, however, the electronics 112 includes a single one of the amplifiers 112*h* configured to output amplified audio signals to a plurality of the transducers 114. In some other embodiments, the electronics 112 omits the amplifiers 112*h*.

The transducers 114 (e.g., one or more speakers and/or speaker drivers) receive the amplified audio signals from the amplifier 112*h* and render or output the amplified audio signals as sound (e.g., audible sound waves having a frequency between about 20 Hertz (Hz) and 20 kilohertz (kHz)). In some embodiments, the transducers 114 can comprise a single transducer. In other embodiments, however, the transducers 114 comprise a plurality of audio transducers. In some embodiments, the transducers 114 comprise more than one type of transducer. For example, the transducers 114 can include one or more low frequency transducers (e.g., subwoofers, woofers), mid-range frequency transducers (e.g., mid-range transducers, mid-woofers), and one or more high frequency transducers (e.g., one or more tweeters). As used herein, "low frequency" can generally refer to audible frequencies below about 500 Hz, "mid-range frequency" can generally refer to audible frequencies between about 500 Hz and about 2 kHz, and "high frequency" can generally refer to audible frequencies above 2 kHz. In certain embodiments, however, one or more of the transducers 114 comprise transducers that do not adhere to the foregoing frequency ranges. For example, one of the transducers 114 may comprise a mid-woofer transducer configured to output sound at frequencies between about 200 Hz and about 5 kHz.

Figure 1D:
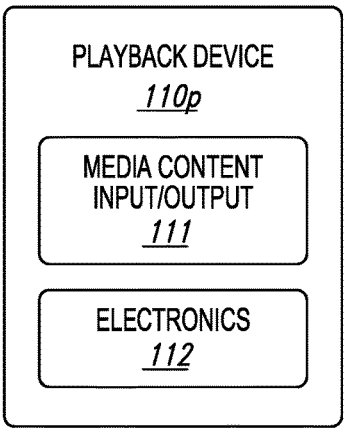
FIG. 1D is a block diagram of a playback device.

By way of illustration, SONOS, Inc. presently offers (or has offered) for sale certain playback devices including, for example, a "SONOS ONE," "PLAY:1," "PLAY:3," "PLAY:5," "PLAYBAR," "PLAYBASE," "BEAM," "AMP," "CONNECT," and "SUB." Other suitable playback devices may additionally or alternatively be used to implement the playback devices of example embodiments disclosed herein. Additionally, one of ordinary skilled in the art will appreciate that a playback device is not limited to the examples described herein or to SONOS product offerings. In some embodiments, for example, one or more playback devices 110 comprises wired or wireless headphones (e.g., over-the-ear headphones, on-ear headphones, in-ear earphones). In other embodiments, one or more of the playback devices 110 comprise a docking station and/or an interface configured to interact with a docking station for personal mobile media playback devices. In certain embodiments, a playback device may be integral to another device or component such as a television, a lighting fixture, or some other device for indoor or outdoor use. In some embodiments, a playback device omits a user interface and/or one or more transducers. For example, FIG. 1D is a block diagram of a playback device 110*p* comprising the input/output 111 and electronics 112 without the user interface 113 or transducers 114.

Figure 1E:
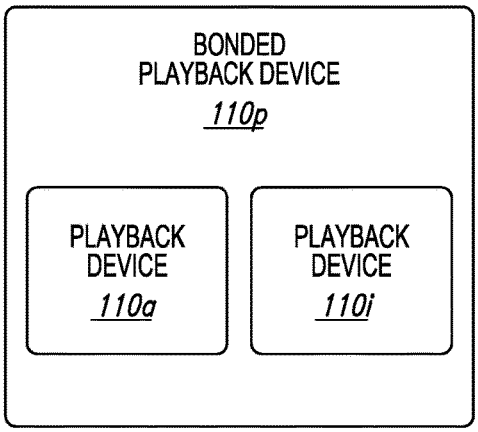
FIG. 1E is a block diagram of a network microphone device.

FIG. 1E is a block diagram of a bonded playback device 110*q* comprising the playback device 110*a* (FIG. 1C) sonically bonded with the playback device 110*i* (e.g., a subwoofer) (FIG. 1A). In the illustrated embodiment, the playback devices 110*a* and 110*i* are separate ones of the playback devices 110 housed in separate enclosures. In some embodiments, however, the bonded playback device 110*q* comprises a single enclosure housing both the playback devices 110*a* and 110*i*. The bonded playback device 110*q* can be configured to process and reproduce sound differently than an unbonded playback device (e.g., the playback device 110*a* of FIG. 1C) and/or paired or bonded playback devices (e.g., the playback devices 110*l* and 110*m* of FIG. 1B). In some embodiments, for example, the playback device 110*a* is full-range playback device configured to render low frequency, mid-range frequency, and high frequency audio content, and the playback device 110*i* is a subwoofer configured to render low frequency audio content. In some aspects, the playback device 110*a*, when bonded with the first playback device, is configured to render only the mid-range and high frequency components of a particular audio content, while the playback device 110*i* renders the low frequency component of the particular audio content. In some embodiments, the bonded playback device 110*q* includes additional playback devices and/or another bonded playback device. e c. Suitable Network Microphone Devices (NMDs)

Figure 1F:
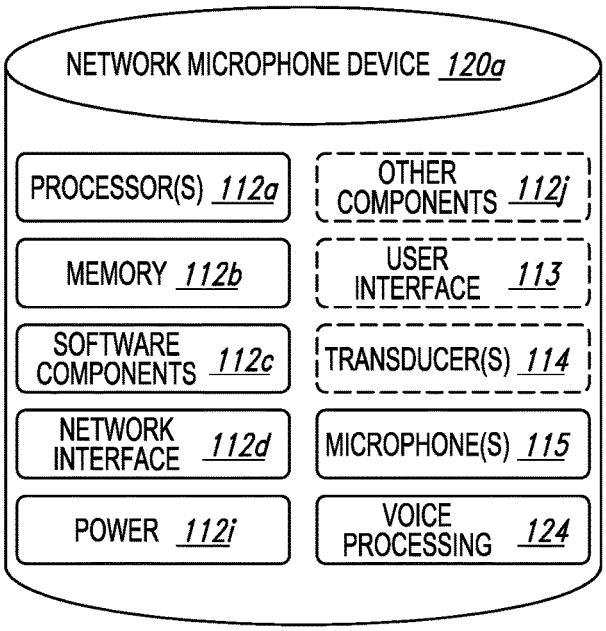
FIG. 1F is a block diagram of a network microphone device.

FIG. 1F is a block diagram of the NMD 120*a* (FIGS. 1A and 1B). The NMD 120*a* includes one or more voice processing components 124 (hereinafter "the voice components 124") and several components described with respect to the playback device 110*a* (FIG. 1C) including the processors 112*a*, the memory 112*b*, and the microphones 115. The NMD 120*a* optionally comprises other components also included in the playback device 110*a* (FIG. 1C), such as the user interface 113 and/or the transducers 114. In some embodiments, the NMD 120*a* is configured as a media playback device (e.g., one or more of the playback devices 110), and further includes, for example, one or more of the audio components 112*g* (FIG. 1C), the amplifiers 114, and/or other playback device components. In certain embodiments, the NMD 120*a* comprises an Internet of Things (IoT) device such as, for example, a thermostat, alarm panel, fire and/or smoke detector, etc. In some embodiments, the NMD 120*a* comprises the microphones 115, the voice processing 124, and only a portion of the components of the electronics 112 described above with respect to FIG. 1B. In some aspects, for example, the NMD 120*a* includes the processor 112*a* and the memory 112*b* (FIG. 1B), while omitting one or more other components of the electronics 112. In some embodiments, the NMD 120*a* includes additional components (e.g., one or more sensors, cameras, thermometers, barometers, hygrometers).

Figure 1G:
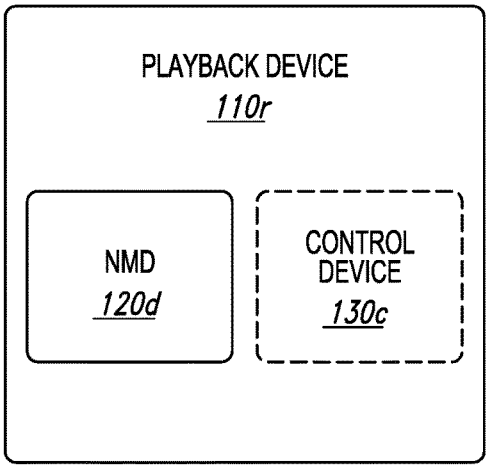
FIG. 1G is a block diagram of a playback device.

In some embodiments, an NMD can be integrated into a playback device. FIG. 1G is a block diagram of a playback device 110*r* comprising an NMD 120*d*. The playback device 110*r* can comprise many or all of the components of the playback device 110*a* and further include the microphones 115 and voice processing 124 (FIG. 1F). The playback device 110*r* optionally includes an integrated control device 130*c*. The control device 130*c* can comprise, for example, a user interface (e.g., the user interface 113 of FIG. 1B) configured to receive user input (e.g., touch input, voice input) without a separate control device. In other embodiments, however, the playback device 110*r* receives commands from another control device (e.g., the control device 130*a* of FIG. 1B).

Referring again to FIG. 1F, the microphones 115 are configured to acquire, capture, and/or receive sound from an environment (e.g., the environment 101 of FIG. 1A) and/or a room in which the NMD 120*a* is positioned. The received sound can include, for example, vocal utterances, audio played back by the NMD 120*a* and/or another playback device, background voices, ambient sounds, etc. The microphones 115 convert the received sound into electrical signals to produce microphone data. The voice processing 124 receives and analyzes the microphone data to determine whether a voice input is present in the microphone data. The voice input can comprise, for example, an activation word followed by an utterance including a user request. As those of ordinary skill in the art will appreciate, an activation word is a word or other audio cue that signifying a user voice input. For instance, in querying the AMAZON® VAS, a user might speak the activation word "Alexa." Other examples include "Ok, Google" for invoking the GOOGLE® VAS and "Hey, Siri" for invoking the APPLE® VAS.

After detecting the activation word, voice processing 124 monitors the microphone data for an accompanying user request in the voice input. The user request may include, for example, a command to control a third-party device, such as a thermostat (e.g., NEST® thermostat), an illumination device (e.g., a PHILIPS HUE® lighting device), or a media playback device (e.g., a Sonos® playback device). For example, a user might speak the activation word "Alexa" followed by the utterance "set the thermostat to 68 degrees" to set a temperature in a home (e.g., the environment 101 of FIG. 1A). The user might speak the same activation word followed by the utterance "turn on the living room" to turn on illumination devices in a living room area of the home. The user may similarly speak an activation word followed by a request to play a particular song, an album, or a playlist of music on a playback device in the home.

d. Suitable Control Devices

Figure 1H:
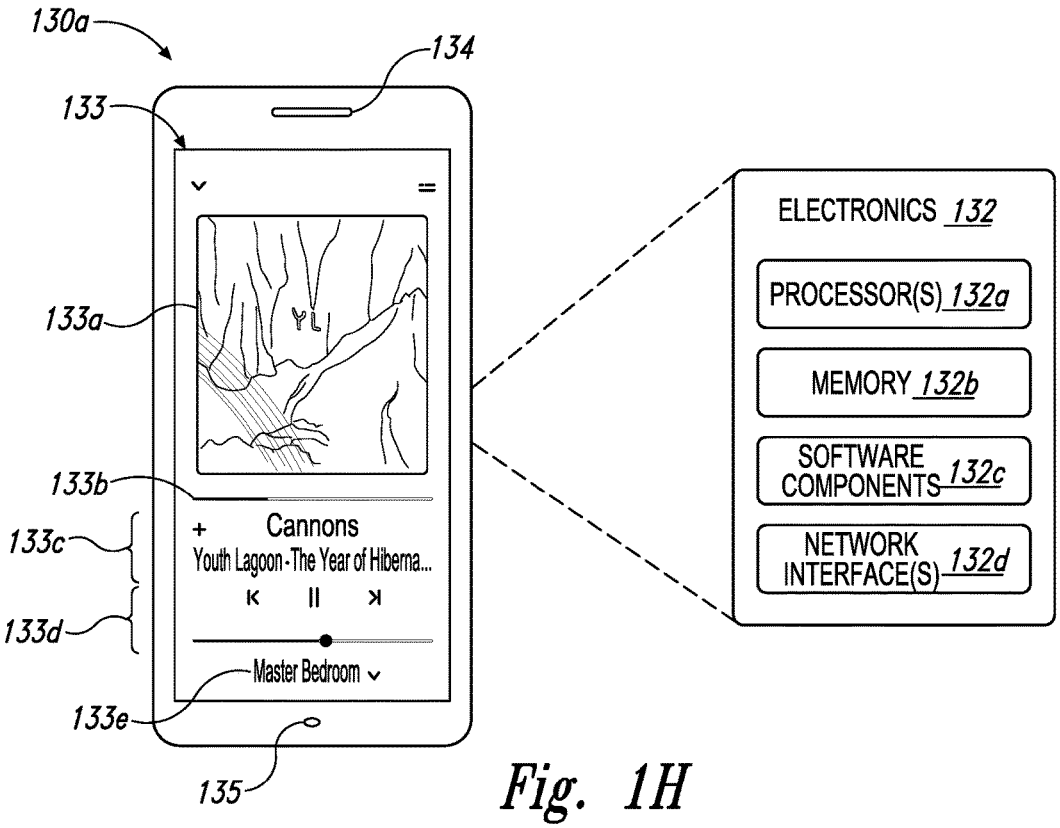
FIG. 1H is a partial schematic diagram of a control device.

FIG. 1H is a partially schematic diagram of the control device 130*a* (FIGS. 1A and 1B). As used herein, the term "control device" can be used interchangeably with "controller" or "control system." Among other features, the control device 130*a* is configured to receive user input related to the media playback system 100 and, in response, cause one or more devices in the media playback system 100 to perform an action(s) or operation(s) corresponding to the user input. In the illustrated embodiment, the control device 130*a* comprises a smartphone (e.g., an iPhone™, an Android phone) on which media playback system controller application software is installed. In some embodiments, the control device 130*a* comprises, for example, a tablet (e.g., an iPad™), a computer (e.g., a laptop computer, a desktop computer), and/or another suitable device (e.g., a television, an automobile audio head unit, an IoT device). In certain embodiments, the control device 130*a* comprises a dedicated controller for the media playback system 100. In other embodiments, as described above with respect to FIG. 1G, the control device 130*a* is integrated into another device in the media playback system 100 (e.g., one more of the playback devices 110, NMDs 120, and/or other suitable devices configured to communicate over a network).

The control device 130*a* includes electronics 132, a user interface 133, one or more speakers 134, and one or more microphones 135. The electronics 132 comprise one or more processors 132*a* (referred to hereinafter as "the processors 132*a*"), a memory 132*b*, software components 132*c*, and a network interface 132*d*. The processor 132*a* can be configured to perform functions relevant to facilitating user access, control, and configuration of the media playback system 100. The memory 132*b* can comprise data storage that can be loaded with one or more of the software components executable by the processor 302 to perform those functions. The software components 132*c* can comprise applications and/or other executable software configured to facilitate control of the media playback system 100. The memory 112*b* can be configured to store, for example, the software components 132*c*, media playback system controller application software, and/or other data associated with the media playback system 100 and the user.

The network interface 132*d* is configured to facilitate network communications between the control device 130*a* and one or more other devices in the media playback system 100, and/or one or more remote devices. The network interface may include, for instance, a single- or dual-band antenna as discussed herein. In some embodiments, the network interface 132*d* is configured to operate according to one or more suitable communication industry standards (e.g., infrared, radio, wired standards including IEEE 802.3, wireless standards including IEEE 802.11a, 802.11b, 802.11g, 802.11n, 802.11ac, 802.15, 4G, LTE). The network interface 132*d* can be configured, for example, to transmit data to and/or receive data from the playback devices 110, the NMDs 120, other ones of the control devices 130, one of the computing devices 106 of FIG. 1B, devices comprising one or more other media playback systems, etc. The transmitted and/or received data can include, for example, playback device control commands, state variables, playback zone and/or zone group configurations. For instance, based on user input received at the user interface 133, the network interface 132*d* can transmit a playback device control command (e.g., volume control, audio playback control, audio content selection) from the control device 304 to one or more of the playback devices 100. The network interface 132*d* can also transmit and/or receive configuration changes such as, for example, adding/removing one or more playback devices 100 to/from a zone, adding/removing one or more zones to/from a zone group, forming a bonded or consolidated player, separating one or more playback devices from a bonded or consolidated player, among others.

The user interface 133 is configured to receive user input and can facilitate control of the media playback system 100. The user interface 133 includes media content art 133*a* (e.g., album art, lyrics, videos), a playback status indicator 133*b* (e.g., an elapsed and/or remaining time indicator), media content information region 133*c*, a playback control region 133*d*, and a zone indicator 133*e*. The media content information region 133*c* can include a display of relevant information (e.g., title, artist, album, genre, release year) about media content currently playing and/or media content in a queue or playlist. The playback control region 133*d* can include selectable (e.g., via touch input and/or via a cursor or another suitable selector) icons to cause one or more playback devices in a selected playback zone or zone group to perform playback actions such as, for example, play or pause, fast forward, rewind, skip to next, skip to previous, enter/exit shuffle mode, enter/exit repeat mode, enter/exit cross fade mode, etc. The playback control region 133*d* may also include selectable icons to modify equalization settings, playback volume, and/or other suitable playback actions. In the illustrated embodiment, the user interface 133 comprises a display presented on a touch screen interface of a smartphone (e.g., an iPhone™, an Android phone). In some embodiments, however, user interfaces of varying formats, styles, and interactive sequences may alternatively be implemented on one or more network devices to provide comparable control access to a media playback system.

The one or more speakers 134 (e.g., one or more transducers) can be configured to output sound to the user of the control device 130*a*. In some embodiments, the one or more speakers comprise individual transducers configured to correspondingly output low frequencies, mid-range frequencies, and/or high frequencies. In some aspects, for example, the control device 130*a* is configured as a playback device (e.g., one of the playback devices 110). Similarly, in some embodiments the control device 130*a* is configured as an NMD (e.g., one of the NMDs 120), receiving voice commands and other sounds via the one or more microphones 135.

The one or more microphones 135 can comprise, for example, one or more condenser microphones, electret condenser microphones, dynamic microphones, and/or other suitable types of microphones or transducers. In some embodiments, two or more of the microphones 135 are arranged to capture location information of an audio source (e.g., voice, audible sound) and/or configured to facilitate filtering of background noise. Moreover, in certain embodiments, the control device 130*a* is configured to operate as playback device and an NMD. In other embodiments, however, the control device 130*a* omits the one or more speakers 134 and/or the one or more microphones 135. For instance, the control device 130*a* may comprise a device (e.g., a thermostat, an IoT device, a network device) comprising a portion of the electronics 132 and the user interface 133 (e.g., a touch screen) without any speakers or microphones.

III. Example Dual-Band Antennas

As noted above, dual-band antennas are implemented as part of a communications interface in a wide variety of hardware devices. However, the relatively small form factor of many consumer electronics devices, such as the playback devices and control devices discussed above, can pose challenges in the design of a dual-band antenna.

Figure 2A:
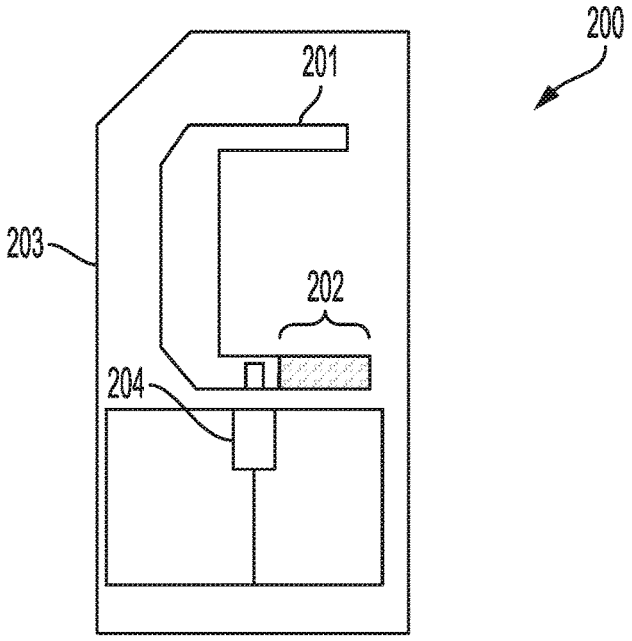
FIG. 2A shows an example prior art dual-band antenna.

For example, FIG. 2A shows an example of a conventional dual-band antenna 200 that may be implemented in, for example, a mobile phone. The dual-band antenna 200 includes a primary radiator 201 that is mounted on a substrate 203. The primary radiator 201 is shown as a bent monopole that is fed from a transmission line 204 and has a single-band resonance at a native frequency. In this example, the primary radiator 201 is responsible for what may be referred to as the low-band resonance (e.g., 2.4 GHz). A second radiator 202, shorter than the primary radiator 201, is then extended from the feed point to form a second, adjacent conductive path. The second radiator 202 has its own resonant frequency and is responsible for what is typically referred to as the high-band resonance (e.g., 5 GHz).

Although the design of the dual-band antenna 200 shown in FIG. 2A allows it to be relatively compact, the design introduces constraints that can make fine tuning the dual-band antenna 200 difficult. For instance, because the two radiating elements share a common feed point from the transmission line 204, and because they are both part of the same conductive structure, a modification to one radiator (e.g., a length modification) to adjust its resonant frequency, for instance, will also affect the other radiator.

Figure 2B:
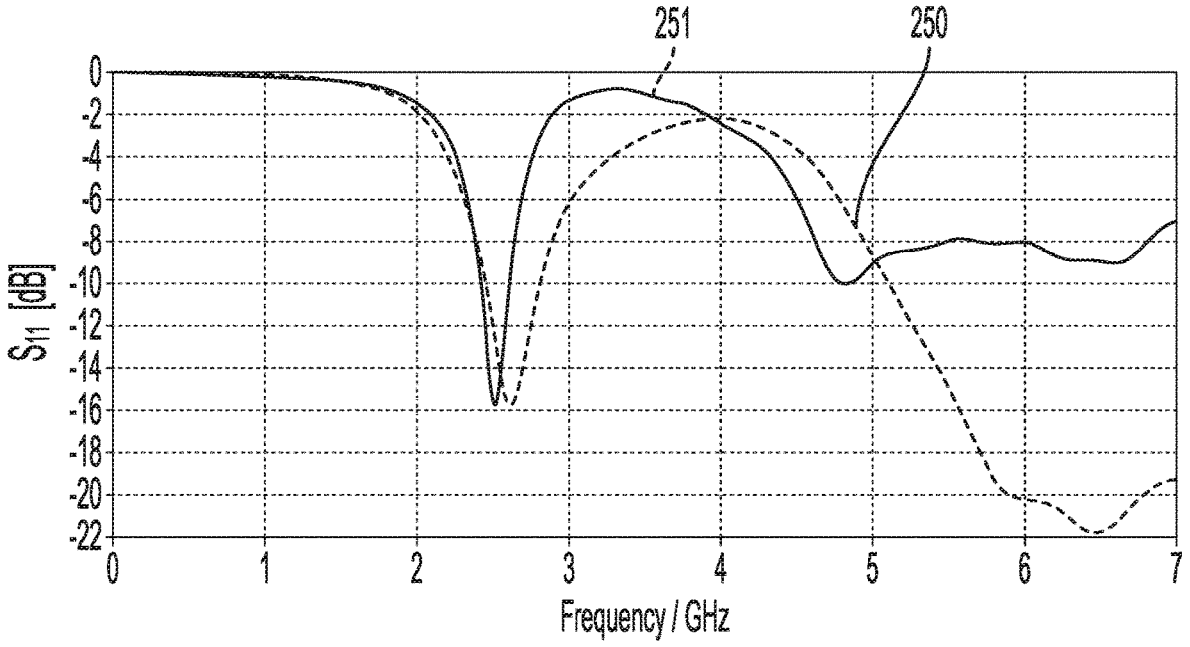
FIG. 2B shows a plot of two example frequency responses for the prior art dual-band antenna of FIG. 2.

This effect can be seen with reference to FIG. 2B, which shows a plot of two example frequency responses for the dual-band antenna 200. The first frequency response 250 illustrates the behavior of the primary radiator 201 acting as a single-band antenna, before the second radiator 202 is added, and shows the low-band resonance at a native frequency between 2 and 3 GHz. Dual-band behavior is then achieved by extending the second radiator 202. The dual-band behavior is represented by the second frequency response 251 shown in FIG. 2B, where the second radiator 202 is responsible for the high-band resonance that can be seen just below 5 GHz. However, as predicted above, the low-band resonance has been affected by the addition of the second radiator 202. For example, as compared to the frequency response 250 the low-band resonance in frequency response 251 has been tuned to a lower frequency (i.e., shifted to the left). Further, the low-band resonance in the frequency response 251 includes a narrower frequency range, which may correspond to a loss in bandwidth for low-band communications. In this way, geometric changes, impedance mismatch optimizations, or other adjustments to one of the two radiators in the dual-band antenna 200 will affect the performance of the other radiator. For this reason, it can be challenging to obtain a desired dual-band antenna behavior.

Figure 3:
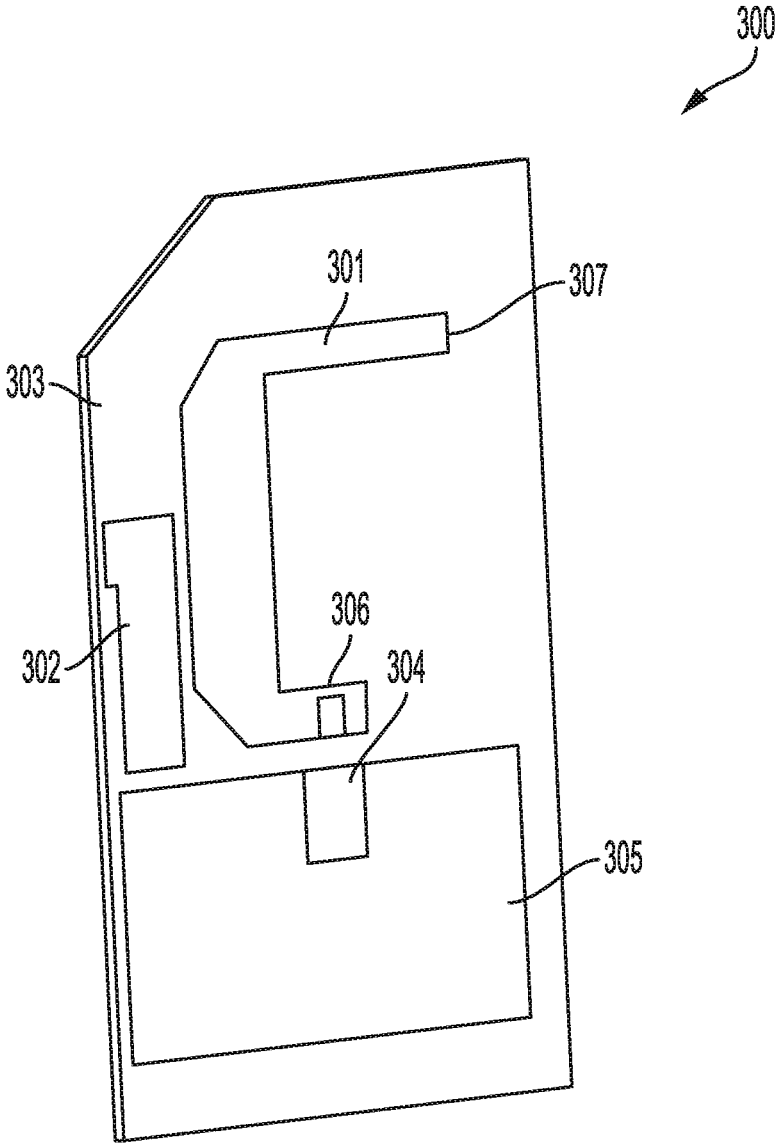
FIG. 3 shows a perspective view of a dual-band antenna according to an example implementation.

Turning now to FIG. 3, an example of a new dual-band antenna design is shown that may mitigate some of the effects discussed above by providing the secondary radiator as a parasitic element that is unconnected to the primary radiator. FIG. 3 shows a dual-band antenna 300 that is disposed on a substrate 303. The substrate may be a printed circuit board (PCB), a flexible printed circuit (FPC), polymide, or similar material for mounting the radiating elements thereon. The dual-band antenna includes a primary radiator 301 disposed on the substrate 303 and connected to a transmission line 304 for driving the primary radiator 301. The transmission line 304 may be, for example, a microstrip, a stripline, or a coaxial cable, among other possibilities.

In some implementations, as shown in FIG. 3, the primary radiator 301 may be arranged as a monopole radiator. Other configurations are also possible, including a dipole radiator for example. In FIG. 3, the primary radiator 301 is a bent monopole having a first end 306 and a second end 307. The dual-band antenna 300 also includes an electrically conductive ground plane disposed on the substrate 303, and the transmission line 304 is connected between the first end 306 of the primary radiator 301 and the ground plane 305. Regardless of its configuration, the primary radiator 301 of the dual-band antenna 300 includes a first resonant frequency when driven via the transmission line 304.

The dual-band antenna 300 also includes a secondary radiator 302 disposed on the substrate 304 and unconnected to the primary radiator 301. Further, and as shown in FIG. 3, the secondary radiator 302 is also unconnected to the ground plane 305. In this way, the secondary radiator 302 is not fed directly from the transmission line 304 or the primary radiator 301, but rather acts as a parasitic element that achieves its resonance by capacitively coupling to the adjacent primary radiator 301. Thus, when the primary radiator 301 is driven via the transmission line 304, it induces a current in the secondary radiator 302 such that the secondary radiator 302 includes a second resonant frequency that is different from the first resonant frequency. The length of the secondary radiator 302 may be determined and/or adjusted based on the desired frequency of operation in the high-band. Importantly, the parasitic arrangement of the secondary radiator 302 in the dual-band antenna 300 may reduce the effect that both the addition of the secondary radiator 302, as well as adjustments to the secondary radiator 302, have on the primary radiator 301, as will be discussed further below.

In some implementations, such as the example shown in FIG. 3, the secondary radiator 302 may be arranged as a monopole radiator. Further, the secondary radiator 302 may be disposed on the substrate 304 such that the secondary radiator 302 is substantially parallel to the primary radiator 301. In such an arrangement, the polarization of the two radiating elements will also be linear, and parallel to each other.

Figure 4:
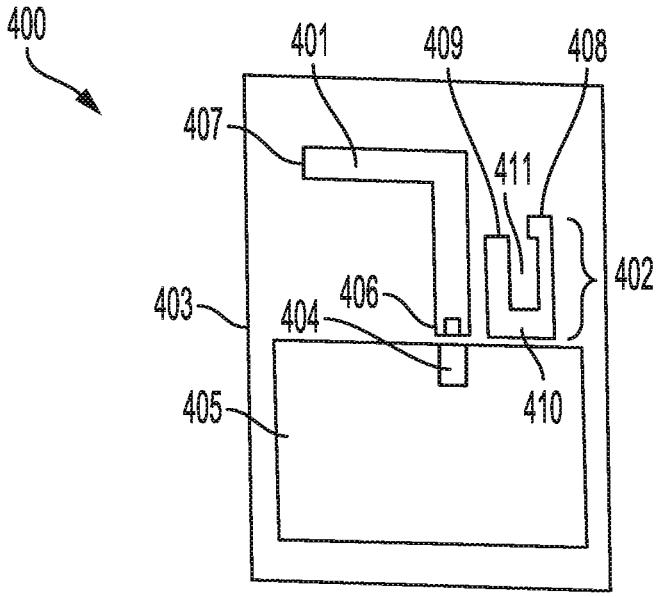
FIG. 4 shows a perspective view of a dual-band antenna according to another example implementation.

FIG. 4 shows a dual-band antenna 400 according to another example implementation. Similar to the example shown in FIG. 3, the dual-band antenna 400 includes a primary radiator 401 arranged as a bent monopole having a first end 406 and a second end 407, as well as a ground plane 405 disposed on a substrate 403. A transmission line 404 is connected between the ground plane 405 and the first end 406 of the primary radiator 401. The secondary radiator 402 is disposed on the substrate 403 and is unconnected to both the primary radiator 401 and the ground plane 405. However, the secondary radiator 402 in FIG. 4 is arranged as a slotted radiator having two parallel arms 408 and 409 that are joined by a base section 410 and separated by a slot 411. Further, the two arms 408 and 409 of the secondary radiator 402 may be substantially parallel to the primary radiator 401.

In this arrangement, similar to the example shown in FIG. 3, the secondary radiator 402 acts as a parasitic element and capacitively couples to the primary radiator 401 to achieve its resonant behavior. However, the slotted secondary radiator 402 has, by definition, a polarization that is horizontal (as arranged in FIG. 4), and orthogonal to the vertical polarization of the primary radiator 401. This orthogonal arrangement allows for the dual-band antenna 400 to be cross-polarized between the low-band and high-band ranges, which may also provide for improved signal coverage and polarization diversity in some implementations where there are barriers or other constraints that might otherwise inhibit RF communication in one direction, but not the other.

Figure 5:
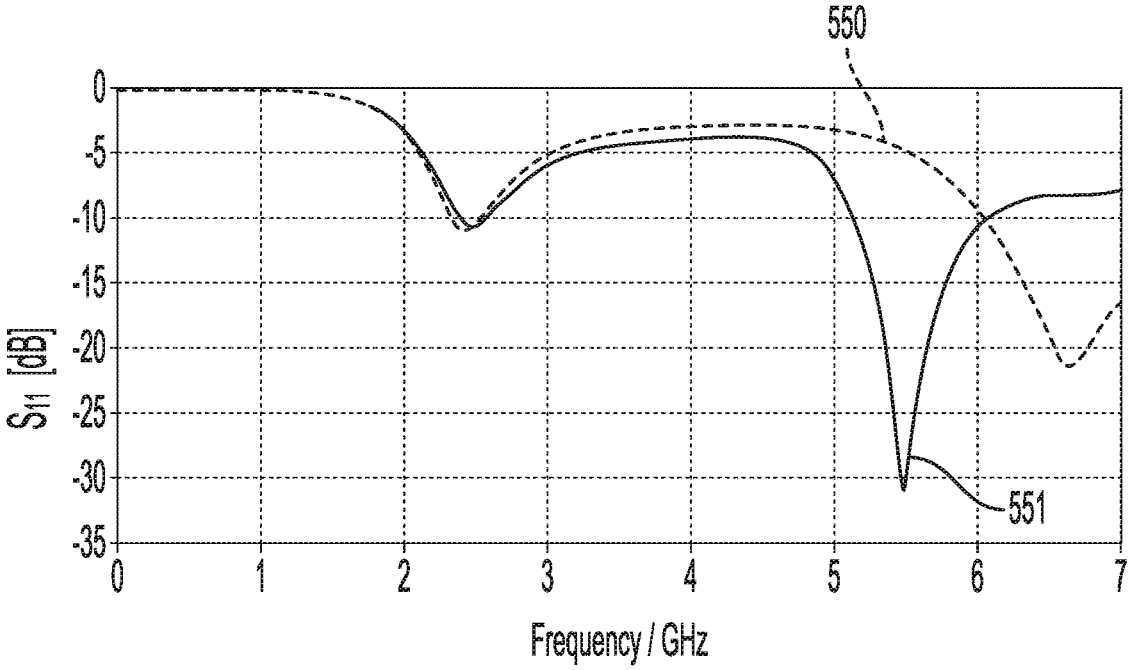
FIG. 5 shows a plot of two example frequency responses for the dual-band antenna of FIG. 4.

As mentioned above, the impact of the parasitic secondary radiator 402 on the behavior of the primary radiator 401 is improved over some conventional dual-band antennas. FIG. 5 shows a plot of two example frequency responses for the dual-band antenna 400. The first frequency response 550 shows the behavior of the primary radiator 401 acting as a single-band antenna, before the secondary radiator 402 is added. Dual-band behavior is then achieved by adding the secondary radiator 402, and is represented by the second frequency response 551, which includes the secondary resonance between 5 and 6 GHz. Although there is a minor shift in the lower frequency band, it is much smaller than that observed in the conventional dual-band antenna discussed above. Further, the example shown in FIG. 5 does not exhibit the same bandwidth reduction in the low-band as observed previously. Accordingly, the secondary radiator 402 in the dual-band antenna 400 may be adjusted to modify the antenna's high band behavior, for instance, without significantly affecting the primary radiator 401 and the antenna's low-band behavior.

Figure 6:
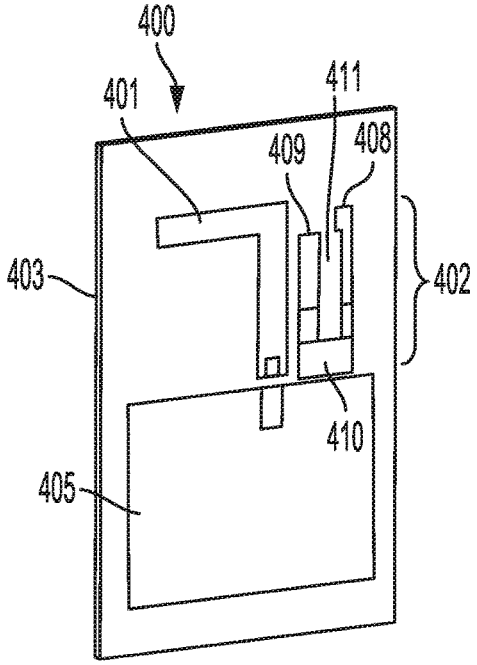
FIG. 6 shows a perspective view of dual-band antenna according to another example implementation.
Figure 7:
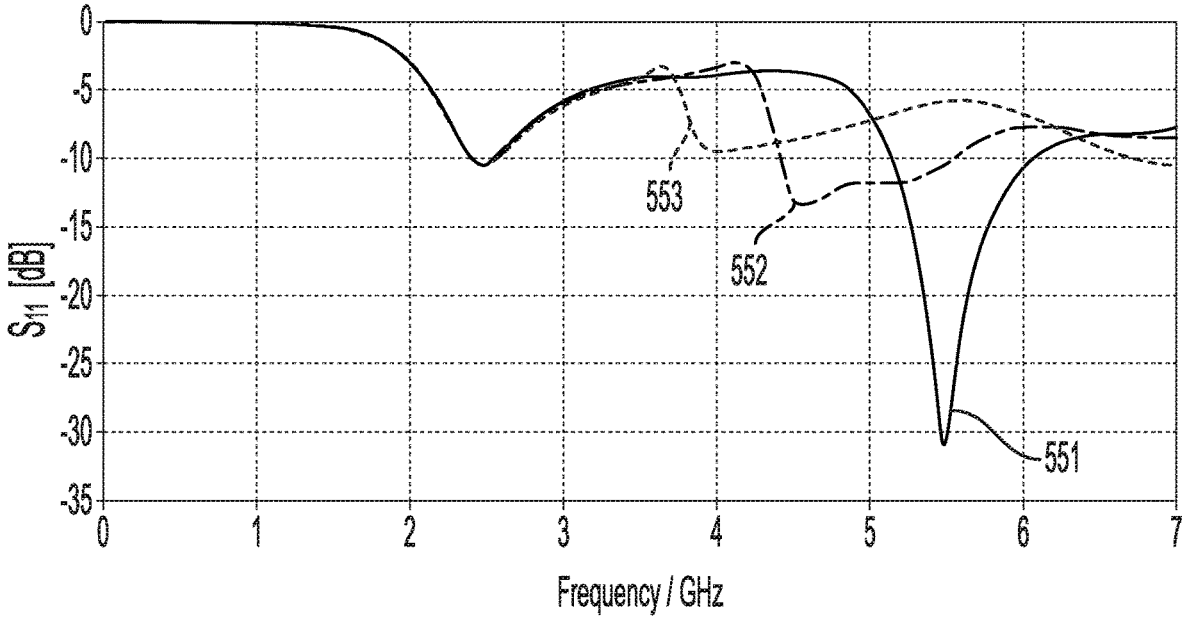
FIG. 7 shows a plot of three example frequency responses for the dual-band antenna of FIG. 6.

FIGS. 6 and 7 further illustrate this point. FIG. 6 shows another example of the dual-band antenna 400. As can be seen in FIG. 6, the length of the arms 408 and 409 of the secondary radiator 402 have been extended from their initial position shown in FIG. 4. This also extends the length of the slot 411 and alters the high-band frequency response of the dual-band antenna 400, as shown in FIG. 7.

FIG. 7 shows a plot of three example frequency responses for the modified version of the dual-band antenna 400 that is shown in FIG. 6. The three responses represent the behavior of the dual-band antenna 400 as the length of the slot 411 is swept from its initial, shorter length, as shown in FIG. 4, to the longer length shown in FIG. 6. For example, the frequency response 551 shown in FIG. 7 is the same frequency response 551 as shown in FIG. 5. As the length of the slot 411 of the secondary radiator 402 increases, the high-band is tuned lower (i.e., shifted left) and the impedance is decreased, as shown by the frequency response 552. As the length of the slot 411 is further increased and reaches the length shown in FIG. 6, the high-band is further adjusted, and is represented by the frequency response 553.

However, despite the variation in the high-band tuning range based on the changes to the secondary radiator 402, FIG. 7 illustrates that the primary element 401 largely maintains the same resonant behavior in the low-band range. This effect may allow the designer of a dual-band antenna more freedom in determining the design of a dual-band antenna, as it reduces the interdependence between the behavior of the two radiating elements. For instance, the primary radiator 401 can be designed for a desired low-band performance, and then secondary radiator 402 can be designed for a desired high-band performance without significantly altering the low-band behavior of the primary radiator 401. This may avoid what might otherwise be an iterative and tedious design process.

Moreover, the advantages of the parasitic secondary radiators discussed above also have additional practical applications that may allow a dual-band antenna increased operational flexibility. For example, one or more elements, such as a variable inductor or a variable capacitor, may be added to the secondary radiator that can be used to alter its effective electrical length, resulting in an adjustment to the high-band behavior similar to that shown in FIG. 7.

Figure 8:
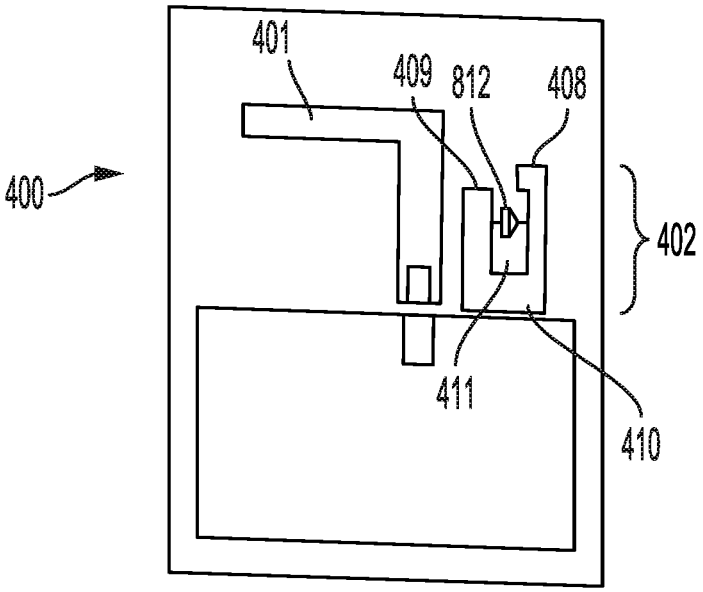
FIG. 8 shows a perspective view of a dual-band antenna according to another example implementation.

For instance, referring now to FIG. 8, the dual-band antenna 400 discussed above is shown, including an additional lumped inductor 812 applied at the slot 411. The inductor 812 may then be used to manipulate the effective length of the slot 411. For example, the inductor 812 may include a multi-state switch having difference inductance values that can be used to set its effective position within the slot 411, thereby manipulating the effective length of the slot 411 and the high-band radiation of the secondary radiator 402. Further, the multiple inductor states can be specified to desired levels such that controlled adjustments to the high-band may be made, all while leaving the low-band behavior of the dual-band antenna 400 relatively unaffected. In addition to the initial design flexibility discussed above, this may also allow the dual-band antenna to be tuned based the environment where it is being operated, based on the constraints of the environment.

Figure 9:
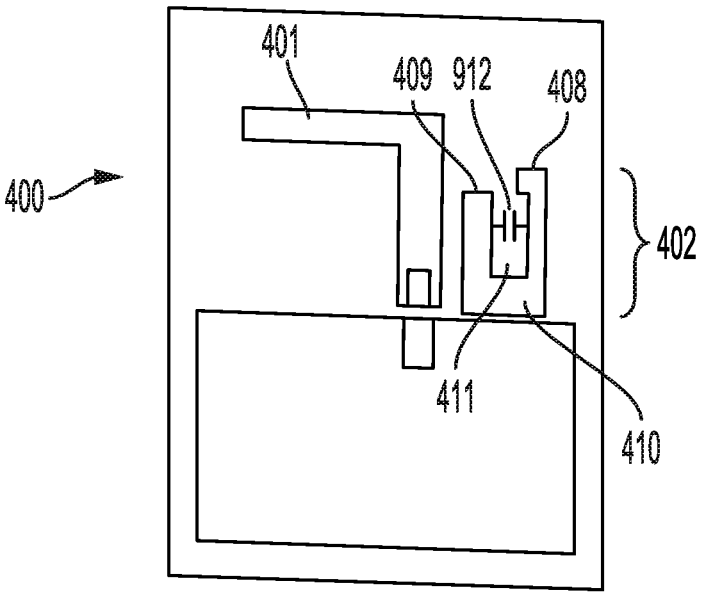
FIG. 9 shows a perspective view of a dual-band antenna according to another example implementation.

In a similar way, as shown in FIG. 9, a variable capacitor 912 may be applied at the slot 411. Like the inductor 812, the capacitor 912 may be configured to adjust the electrical length of the slot 411 to tune the high-band frequency of the secondary radiator 402. Combinations of one or more inductors, capacitors, or both are also possible to achieve similar effects.

Useful applications for a dual-band antenna that is adjustable in this way are numerous. For example, a device including the dual-band antenna 400 shown in FIG. 8 may be involved in different wireless communications situations that benefit from different high-band frequency responses. In some implementations, the device may benefit from a shallower frequency response that delivers the highest amount of power to the system, whereas another application may call for relatively low antenna gain. As another example, the secondary radiator 402 of the dual-band antenna 400 may be manipulated to bias the high-band resonance away from an operational frequency band that is restricted in some geographic areas, such as certain Unlicensed National Information Infrastructure (UNIT) channels at 5 GHz.

As another example, there may be instances where it is desirable to utilize the flexibility of the dual-band antenna 400 discussed herein to manipulate the performance in the high-band range to intentionally avoid coupling with signals in that range. For instance, an example playback device as discussed herein may be capable of communications via either a Bluetooth link (e.g., operating in a single band around 2.4 GHz) or via a WiFi network (e.g., a dual band network operating around 2.4 GHz and 5 GHz). When communicating via Bluetooth, it may be desirable to avoid potential noise by intentionally degrading the high-band response of the dual-band antenna so as not to couple with 5 GHz WiFi signals, and instead focus purely on the 2.4 GHz band. Various other possibilities exist.

Another advantage that arises from the flexibility of the independent, secondary radiator 402 discussed herein is its ability to adapt to future communication standards that may arise. For instance, most current WiFi standards generally operate within a high-band range between 5-6 GHz. However, new and upcoming standards (e.g., 802.11ax) may use frequency bands greater than 6 GHz. Thus, a playback device utilizing one of the example dual-band antennas 400 discussed herein may update its communication capabilities to take advantage of the most current standards. Moreover, these and other advantages are not limited to the playback devices mentioned herein, but could be equally applied to any network communication device.

Figure 10:
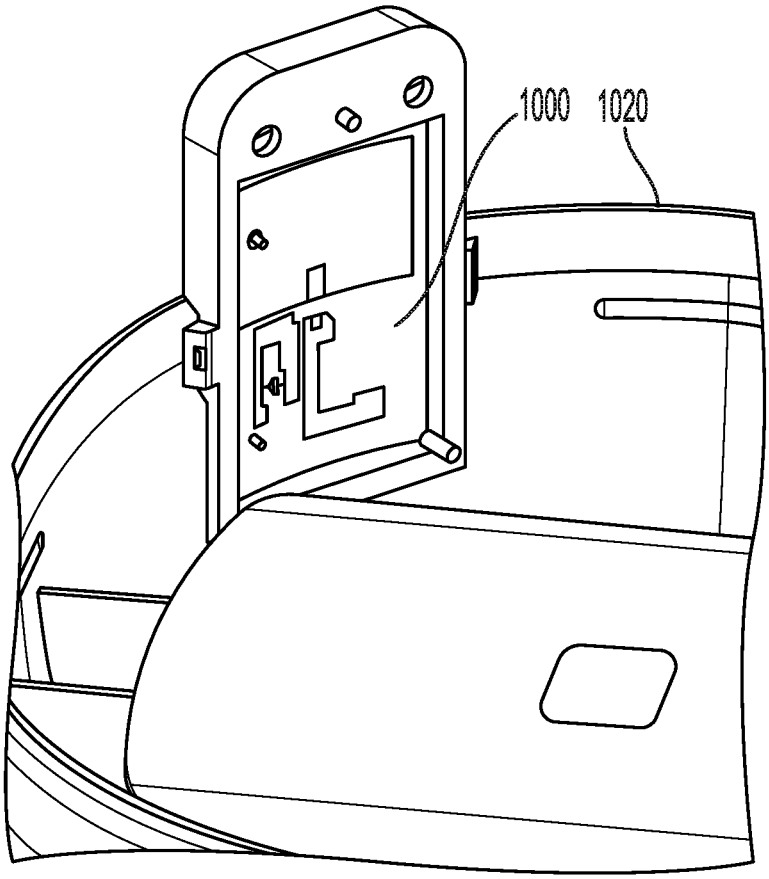
FIG. 10 shows a partial cut away view of a playback device including a dual-band antenna according to an example implementation.
Figure 11:
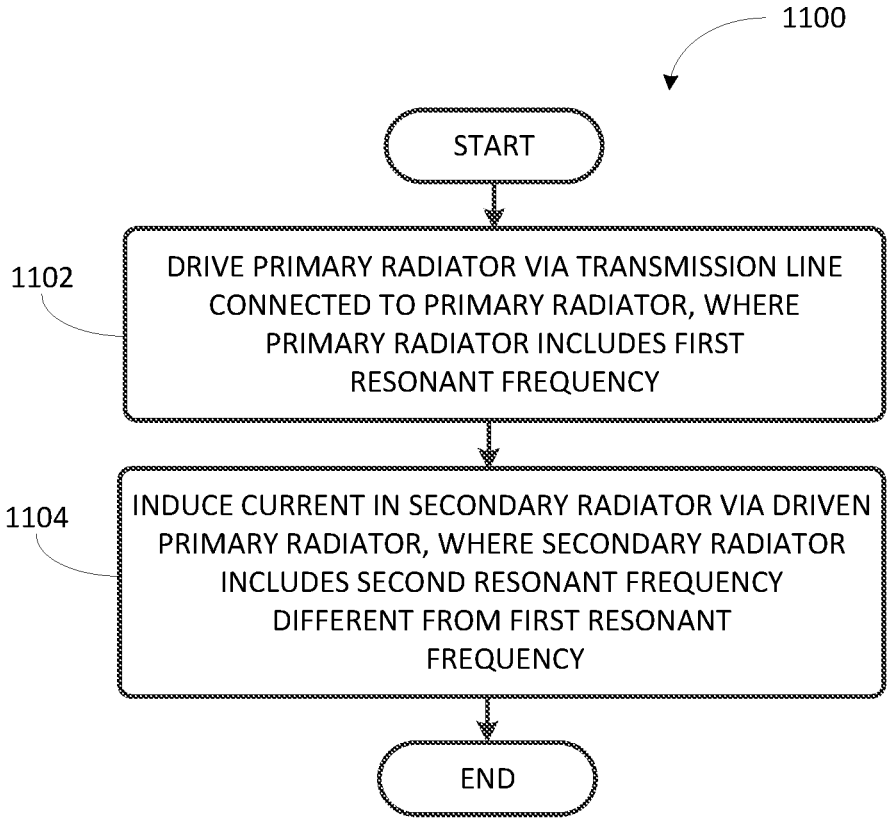
FIG. 11 shows a flowchart of an example method for driving a dual-band antenna.

FIG. 10 shows a partial cut away view of a playback device 1020 including a dual-band antenna 1000 according to an example implementation. The dual-band antenna 1000 may be substantially similar to, for example, the dual-band antenna 400 including the lumped inductor 812 shown in FIG. 8. The playback device 1020 may be any of the playback devices shown in FIG. 1A-1G and discussed above, or any other playback device. Further, the dual-band antennas having a parasitic secondary radiator, as discussed above, are not limited to use within a playback device. Rather, they may be used in any wireless communications device that would benefit from a dual-band antenna having the advantages discussed herein.

FIG. 10 illustrates a flowchart 1100 of an example method for driving a dual-band antenna, such as the dual-band antenna 300 shown in FIG. 3 or the dual-band antenna 400 shown in FIGS. 4 and 8-9. The following examples will refer to the dual-band antenna 400.

At block 1102, the method 1100 includes driving a primary radiator 401 via a transmission line 404 connected to the primary radiator 401. The primary radiator 401 is disposed on a substrate 403 and has a first resonant frequency. The dual-band antenna 400 may also include an electrically conductive ground plane 405 disposed on the substrate 403, and the transmission line may be connected between a first end 406 of the primary radiator 401 and the ground plane 405. The primary radiator 401 may be arranged as a monopole radiator as shown in the examples discussed herein, although other configurations are also possible.

At block 1104, the method 1104 includes inducing a current in a secondary radiator 402 via the driven primary radiator 401, where the secondary radiator 402 is disposed on the substrate 403 and unconnected to the primary radiator 401. The secondary radiator 402 may also be unconnected to the ground plane 405. The secondary radiator 402 has a second resonant frequency different from the first resonant frequency. As discussed above, the secondary radiator 402 may be responsible for the high-band resonant behavior of the dual-band antenna 400, while the primary radiator 401 is responsible for the low-band resonant behavior.

In some implementations, the secondary radiator 402 may be arranged as a monopole radiator and disposed on the substrate such that the secondary radiator 402 is substantially parallel to the primary radiator 401. Additionally or alternatively, the secondary radiator 402 may be arranged as a slotted radiator having two parallel arms 408 and 409 joined by a base section 410 and separated by a slot 411. Further, the two parallel arms 408 and 409 of the secondary radiator 402, and thus the orientation of the slot 411, may be substantially parallel to the primary radiator 401.

Further, the primary radiator 401 may include a first polarization and the secondary radiator 402 may include a second polarization that is substantially orthogonal to the first polarization. For instance, in the dual-band antenna 400 shown in the FIGS., the primary radiator 401 has a linear, vertical polarization based on the orientation of the monopole radiator. The secondary radiator 402 has an orthogonal polarization that is linear and horizontal, based on the orientation of the slot 411.

In some implementations, as shown in FIG. 8, the dual-band antenna 400 may include a variable inductor 812 coupled to the secondary radiator 402. In such examples, the method 1100 may include adjusting, via the variable inductor 812, an electrical length of the slot 411 to tune the second resonant frequency of the secondary radiator 402. Various benefits may be achieved from such an adjustable dual-band antenna 400, as mentioned above. Similarly, and as shown in FIG. 9, the dual-band antenna 400 may include a variable capacitor 912 coupled to the secondary radiator 402. In such examples, the method 1100 may include adjusting, via the variable capacitor 912, an electrical length of the slot 411 to tune the second resonant frequency of the secondary radiator 402.

IV. Conclusion

The above discussions relating to playback devices, controller devices, playback zone configurations, and media content sources provide only some examples of operating environments within which functions and methods described below may be implemented. Other operating environments and configurations of media playback systems, playback devices, and network devices not explicitly described herein may also be applicable and suitable for implementation of the functions and methods.

The description above discloses, among other things, various example systems, methods, apparatus, and articles of manufacture including, among other components, firmware and/or software executed on hardware. It is understood that such examples are merely illustrative and should not be considered as limiting. For example, it is contemplated that any or all of the firmware, hardware, and/or software aspects or components can be embodied exclusively in hardware, exclusively in software, exclusively in firmware, or in any combination of hardware, software, and/or firmware. Accordingly, the examples provided are not the only ways) to implement such systems, methods, apparatus, and/or articles of manufacture.

Additionally, references herein to "embodiment" means that a particular feature, structure, or characteristic described in connection with the embodiment can be included in at least one example embodiment of an invention. The appearances of this phrase in various places in the specification are not necessarily all referring to the same embodiment, nor are separate or alternative embodiments mutually exclusive of other embodiments. As such, the embodiments described herein, explicitly and implicitly understood by one skilled in the art, can be combined with other embodiments.

The specification is presented largely in terms of illustrative environments, systems, procedures, steps, logic blocks, processing, and other symbolic representations that directly or indirectly resemble the operations of data processing devices coupled to networks. These process descriptions and representations are typically used by those skilled in the art to most effectively convey the substance of their work to others skilled in the art. Numerous specific details are set forth to provide a thorough understanding of the present disclosure. However, it is understood to those skilled in the art that certain embodiments of the present disclosure can be practiced without certain, specific details. In other instances, well known methods, procedures, components, and circuitry have not been described in detail to avoid unnecessarily obscuring aspects of the embodiments. Accordingly, the scope of the present disclosure is defined by the appended claims rather than the foregoing description of embodiments.

When any of the appended claims are read to cover a purely software and/or firmware implementation, at least one of the elements in at least one example is hereby expressly defined to include a tangible, non-transitory medium such as a memory, DVD, CD, Blu-ray, and so on, storing the software and/or firmware.

I claim:

1. A dual-band antenna comprising:

a substrate;

a primary radiator disposed on the substrate and connected to a transmission line for driving the primary radiator, wherein the primary radiator, when driven via the transmission line, comprises a first resonant frequency; and a secondary radiator disposed on the substrate and incapable of being directly connected to the primary radiator, wherein the primary radiator, when driven via the transmission line, induces a current in the secondary radiator such that the secondary radiator comprises a second resonant frequency different from the first resonant frequency, wherein the secondary radiator is arranged as a slotted radiator having two parallel arms joined by a base section and separated by a slot, and wherein the slot is configured to comprise either an open loop or a closed loop that is formed within the slot.

2. The dual-band antenna of claim 1, wherein the primary radiator is arranged as a monopole radiator.

3. The dual-band antenna of claim 2, further comprising:

an electrically conductive ground plane disposed on the substrate, wherein the secondary radiator is incapable of being directly connected to the ground plane.

4. The dual-band antenna of claim 3, wherein the primary radiator comprises a first end and a second end, and wherein the transmission line is connected between the first end of the primary radiator and the ground plane.

5. The dual-band antenna of claim 2, wherein the secondary radiator is arranged as a monopole radiator, and wherein the secondary radiator is disposed on the substrate such that the secondary radiator is substantially parallel to the primary radiator.

6. The dual-band antenna of claim 1, wherein the two parallel arms of the secondary radiator are substantially parallel to the primary radiator.

7. The dual-band antenna of claim 1, wherein the primary radiator comprises a first polarization, and wherein the secondary radiator comprises a second polarization that is substantially orthogonal to the first polarization.

8. The dual-band antenna of claim 1, wherein the slot is configured to comprise an open loop that is formed by a variable capacitor coupled to the secondary radiator, the variable capacitor being configured to adjust an electrical length of the slot to tune the second resonant frequency of the secondary radiator.

9. The dual-band antenna of claim 1, wherein the slot is configured to comprise a closed loop that is formed by a variable inductor coupled to the secondary radiator, the variable inductor being configured to adjust an electrical length of the secondary radiator to tune the second resonant frequency of the secondary radiator.

10. The dual-band antenna of claim 1, wherein the dual-band antenna is formed on a printed circuit board.

11. A method for driving a dual-band antenna, the method comprising:

driving a primary radiator via a transmission line connected to the primary radiator, wherein the primary radiator is disposed on a substrate and comprises a first resonant frequency; and inducing a current in a secondary radiator via the driven primary radiator, wherein the secondary radiator is disposed on the substrate and incapable of being directly connected to the primary radiator, wherein the secondary radiator comprises a second resonant frequency different from the first resonant frequency, wherein the secondary radiator is arranged as a slotted radiator having two parallel arms joined by a base section and separated by a slot, and wherein the slot is configured to comprise either an open loop or a closed loop that is formed within the slot.

12. The method of claim 11, wherein the primary radiator is arranged as a monopole radiator, and wherein the dual-band antenna further comprises an electrically conductive ground plane disposed on the substrate, wherein the secondary radiator is incapable of being directly connected to the ground plane.

13. The method of claim 12, wherein the primary radiator comprises a first end and a second end, and wherein driving the primary radiator via the transmission line comprises driving the primary radiator via the transmission line connected between the first end of the primary radiator and the ground plane.

14. The method of claim 12, wherein the secondary radiator is arranged as a monopole radiator, and wherein the secondary radiator is disposed on the substrate such that the secondary radiator is substantially parallel to the primary radiator.

15. The method of claim 11, wherein the two parallel arms of the secondary radiator are substantially parallel to the primary radiator.

16. The method of claim 11, wherein the primary radiator comprises a first polarization, and wherein the secondary radiator comprises a second polarization that is substantially orthogonal to the first polarization.

17. The method of claim 11, wherein the slot is configured to comprise an open loop that is formed by a variable capacitor coupled to the secondary radiator, the method further comprising:

adjusting, via the variable capacitor, an electrical length of the slot to tune the second resonant frequency of the secondary radiator.

18. The method of claim 11, wherein the slot is configured to comprise a closed loop that is formed by a variable inductor coupled to the secondary radiator, the method further comprising:

adjusting, via the variable inductor, an electrical length of the slot to tune the second resonant frequency of the secondary radiator.

19. The method of claim 11, wherein the dual-band antenna is formed on a printed circuit board.

* * * * *